US009446922B2

(12) United States Patent
Samoto et al.

(10) Patent No.: US 9,446,922 B2
(45) Date of Patent: Sep. 20, 2016

(54) SHEET TRANSPORTING APPARATUS AND IMAGE FORMING SYSTEM

(71) Applicant: BROTHER KOGYO KABUSHIKI KAISHA, Nagoya-shi, Aichi-ken (JP)

(72) Inventors: Kenji Samoto, Nagoya (JP); Kenta Horade, Tokai (JP); Mitsuhiro Nozaki, Nagoya (JP); Hirotaka Aoki, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/040,693

(22) Filed: Sep. 29, 2013

(65) Prior Publication Data

US 2014/0168308 A1 Jun. 19, 2014

(30) Foreign Application Priority Data

Dec. 14, 2012 (JP) ..... 2012-273643

(51) Int. Cl.

| | |
|---|---|
| ***B41J 2/01*** | (2006.01) |
| ***B65H 7/06*** | (2006.01) |
| ***B65H 3/06*** | (2006.01) |
| ***B65H 9/00*** | (2006.01) |

(52) U.S. Cl.

CPC ..... *B65H 7/06* (2013.01); *B65H 3/0684* (2013.01); *B65H 9/008* (2013.01); *B65H 2511/242* (2013.01); *B65H 2511/414* (2013.01); *B65H 2515/704* (2013.01); *B65H 2557/26* (2013.01); *B65H 2557/264* (2013.01); *B65H 2801/39* (2013.01)

(58) Field of Classification Search

USPC ..... 347/16, 19, 104; 318/373

See application file for complete search history.

(56) References Cited

U.S. PATENT DOCUMENTS

| | | | | |
|---|---|---|---|---|
| 7,193,380 | B2 * | 3/2007 | Stout et al. | 318/373 |
| 2003/0184002 | A1 | 10/2003 | Akiyama et al. | |
| 2006/0023051 | A1 * | 2/2006 | Akiyama et al. | 347/104 |
| 2008/0006984 | A1 | 1/2008 | Kakishima | |
| 2012/0248689 | A1 | 10/2012 | Hirano | |

FOREIGN PATENT DOCUMENTS

| | | | |
|---|---|---|---|
| JP | 2003-291433 | A | 10/2003 |
| JP | 2007-196427 | A | 8/2007 |
| JP | 2008-023887 | A | 2/2008 |
| JP | 2008-030465 | A | 2/2008 |
| JP | 2012-213863 | A | 11/2012 |
| JP | 2013-151340 | A | 8/2013 |

OTHER PUBLICATIONS

Office Action issued in related Japanese Patent Application No. 2012-273643, mailed Dec. 22, 2015, including the English translation.

* cited by examiner

*Primary Examiner* — Lam Nguyen

(74) *Attorney, Agent, or Firm* — Merchant & Gould P.C.

(57) ABSTRACT

A sheet transporting apparatus is provided, including a transport mechanism provided with a roller, a motor, a controller, and a measuring input unit, wherein a transport route has a curved area for inverting the sheet, and the controller is constructed such that the control on the motor is executed by a closed loop control system by using a measured value of an control output at an initial stage of the transport of a sheet from a tray, and the control on the motor is switched from the control performed by the closed loop control system to control performed by an open loop control system on condition that a preset phenomenon arises after the sheet is taken out of the tray.

19 Claims, 15 Drawing Sheets

SHEET TRANSPORTING APPARATUS AND IMAGE FORMING SYSTEM

CROSS REFERENCE TO RELATED APPLICATION

The present invention claims priority from Japanese Patent Application No. 2012-273643, filed on Dec. 14, 2012, the disclosure of which is incorporated herein by reference in its entirety.

BACKGROUND OF THE INVENTION

1. Field of the Invention

The present invention relates to a sheet transporting apparatus and an image forming system.

2. Description of the Related Art

An image forming system that includes a paper feeding tray, a feed roller and transporting roller is known. The feed roller feeds the printing paper accommodated in the paper feeding tray. And the feed roller feeds the printing paper toward the transporting roller which is disposed on the downstream of a transport path. These rollers are driven by a motor. According to the image forming system of the type as described above, the printing paper, which is fed from the paper feeding tray, is transported to an image forming area disposed on the further downstream by the transporting roller. Further, the image forming system forms the image on the printing paper which is passed through the image forming area.

Another image forming system is known, wherein the transport path for transporting the printing paper is curved or bent. The curved form of the transport path is provided, for example, in order to miniaturize the image forming system.

SUMMARY OF THE INVENTION

In this context, the curvature of the curved area is increased in some cases in relation to the transport path for the printing paper in order to miniaturize the image forming system. However, when the curvature is increased, the load fluctuation acting on the motor is increased when the printing paper is transported. One of the causes of the increase in the load fluctuation is exemplified by the fact that the restoring force of the printing paper is increased when the curvature is increased. In other words, as the curvature is more increased, the printing paper is in a state of being more bent or curved. Therefore, the restoring force is increased. The load fluctuation tends to be caused especially when the printing paper as the transport object is thick.

On the other hand, a method or technique, in which the closed loop control is performed for the motor for driving the roller, is known as the technique for accurately transporting the printing paper even when any load fluctuation arises. According to the closed loop control, it is possible to adjust the input current to be inputted into the motor corresponding to the magnitude of the load, by observing, for example, the speed (velocity) and/or the position of rotation of the roller.

However, in the case of the closed loop control, when the load fluctuation is increased, the fluctuation of the input current to be inputted into the motor is increased as well. Therefore, if any sudden decrease in the load arises, then the input current to be inputted into the motor is excessively lowered, and there is such a possibility that the output of the motor may be below the reaction force (for example, the kinetic frictional force) which is the force allowed to act on the opposite side in the opposite direction in relation to the transport direction of the printing paper. In this case, the printing paper, which is being transported, is stopped.

When the printing paper is stopped during the transport as described above, the frictional force, which is included in the reaction force, is consequently changed from the kinetic frictional force to the static frictional force. On account of this fact, the force, which is required to restart the transport of the printing paper, is increased. In a case in which the transport control is performed for the printing paper by using a small-sized motor having only a low output, it is impossible to generate the force which is not less than the reaction force, and there is such a possibility that the printing paper in the stopped state cannot be transported again.

On the other hand, when a technique, in which a motor having a high output is carried, is adopted in order to avoid this problem, the motor is large-sized. Therefore, in the case of this technique, it is difficult to efficiently miniaturize the image forming system.

The present invention has been made taking the foregoing problem into consideration, an object of which is to provide a technique which makes it possible to adequately transport a sheet to the downstream of a transport path even if a small-sized motor is used when the sheet is transported from a tray along the transport path having a curved area in which the load fluctuation is large.

A sheet transporting apparatus of the present teaching includes a transport mechanism, a motor, a controller, and a measuring input unit. The transport mechanism has a roller, and a sheet as a transport object is taken out of a tray in accordance with rotation of the roller. The sheet is transported to downstream of a transport route continued to the tray in accordance with the rotation of the roller. The motor drives and rotates the roller provided for the transport mechanism.

The controller controls the motor, and the transport of the sheet, which is performed in accordance with the rotation of the roller, is controlled thereby. The measuring input unit measures the control output brought about by the control on the motor, and a measured value of the control output is inputted into the controller. The measuring input unit can be constructed, for example, such that a rotation amount of the roller or the motor is measured as a physical quantity to represent the control output.

The controller executes the control on the motor performed by a closed loop control system by using the measured value of the control output at an initial stage of the transport of the sheet from the tray. On the other hand, the control on the motor is switched from the control performed by the closed loop control system to control performed by an open loop control system on condition that a preset phenomenon arises after the sheet is taken out of the tray.

The reason, why the sheet transporting apparatus of the present invention performs the closed loop control at the initial stage of the transport of the sheet from the tray, is that it is intended to accurately take out the sheet of the tray. When the open loop control is performed at the initial stage of the transport of the sheet from the tray, the following problem arises.

For example, when the tray accommodates a plurality of the sheets, a problem arises such that the overlapped feeding of the sheets tends to occur. According to the present teaching, the closed loop control is performed at the initial stage of the sheet transport from the tray in order to suppress the occurrence of the problem as described above.

On the other hand, when the closed loop control is continued for the transport route in which the load fluctuation is large, there is such a possibility that the sheet, which is being transported, may be stopped when the control input (for example, the input current to be inputted into the motor) is excessively lowered resulting from the load fluctuation. Further, there is such a possibility that the sheet cannot be re-transported as caused by the increase in the reaction force, for example, such that the frictional force, which is allowed to act on the sheet, is changed from the kinetic frictional force to the static frictional force on account of the stop.

In view of the above, according to the present teaching, the open loop control is performed on condition that the preset phenomenon arises so that the influence of the load fluctuation is not exerted on the control input and the sheet, which is being transported, is not stopped. According to the motor control as described above, it is possible to suppress the stop of the sheet, which would be otherwise caused by the decrease in the input current to be inputted into the motor due to the load fluctuation during the open loop control.

Therefore, according to the present teaching, when the sheet is transported from the tray along the transport route having the large load fluctuation, the sheet can be appropriately transported to the downstream of the transport route by using the small-sized motor having the low output.

When the present teaching is applied to the sheet transporting apparatus in which the load fluctuation tends to arise due to the transport route having the curved area, the effect as described above is exhibited more evidently. The sheet transporting apparatus, on which the effect is especially exhibited, can be exemplified, for example, by such a sheet transporting apparatus which has the curved area in order to invert the sheet.

The transport mechanism can be exemplified, for example, by such a transport mechanism that the force is allowed to act on the sheet as the transport object in accordance with the rotation of the roller to separate the sheet from the group of sheets accommodated by the tray, and the sheet is transported to the downstream of the transport route.

As for the transport mechanism as described above, a transport mechanism is known, comprising a roller and an arm which rotatably holds or retains the roller. The arm rotatably holds the roller at one end and the arm has a rotational shaft or axis at the other end. According to this transport mechanism, when the force is allowed to act from the roller to the sheet in the direction directed to the downstream of the transport route in accordance with the rotation of the roller, the reaction arises such that the arm is rotated in the direction to push the sheet about the center of the rotational shaft. Further, the roller, which is held by the arm, intends to rotate in the direction to push the sheet on account of the reaction. Therefore, the pressurization is caused from the roller with respect to the group of sheets on the tray.

In the case of the transport mechanism as described above, the pressure, which is allowed to act on the group of sheets in accordance with the reaction described above, is raised, when the input current to be inputted into the motor is excessively larger than the adequate or proper value corresponding to the load when the sheet is taken out of the tray. Further, the high pressure as described above causes, for example, the occurrence of the overlapped feeding of the sheets. Therefore, when the present invention is adopted for the sheet transport based on the use of the transport mechanism as described above, it is possible to appropriately transport the sheet while suppressing, for example, the overlapped feeding.

DESCRIPTION OF THE PREFERRED EMBODIMENTS

Figure 1:
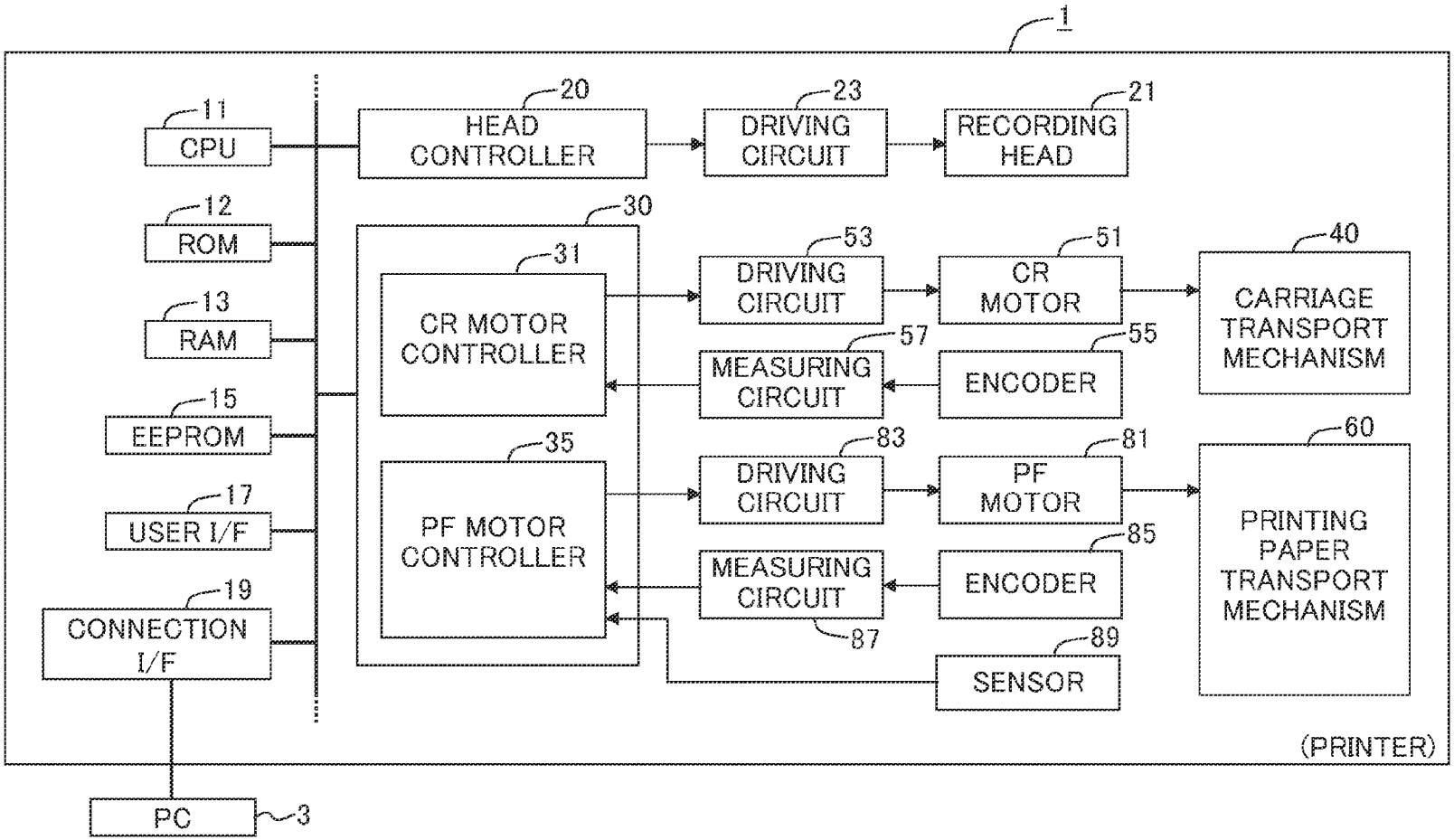
FIG. 1 shows a block diagram illustrating an arrangement of a printer 1.

Embodiments of the present teaching will be explained below with reference to the drawings.

First Embodiment

A printer 1 of this embodiment is ink-jet printer. The ink-jet printer can transport paper Q and can discharge ink liquid droplets onto the printing paper Q to form an image. The printer 1 has CPU 11, ROM 12, RAM 13, EEPROM 15, a user interface 17, a connection interface 19, a head controller 20, and a motor controller 30.

The printer 1 further has a recording head 21 and a driving circuit 23 as the construction for forming the image on the printing paper Q. Further, the printer 1 has a carriage transport mechanism 40, a CR motor 51, a driving circuit 53, a linear encoder 55, and a measuring circuit 57 as the construction for transporting the recording head 21 in the main scanning direction. The printer 1 can observe the displacement of a carriage 41 which carries the recording head 21, by means of the linear encoder 55 and the measuring circuit 57.

Other than the above, the printer 1 has a printing paper transport mechanism 60, a PF motor 81, a driving circuit 83, a rotary encoder 85, a measuring circuit 87, and a sensor 89 as the construction for transporting the printing paper Q in the subsidiary scanning direction perpendicular to the main scanning direction. The printer 1 can observe the transport state of the printing paper Q by means of the rotary encoder 85, the measuring circuit 87, and the sensor 89.

In particular, CPU 11 controls the printer 1 in an integrated manner to realize various functions by executing processes in accordance with the programs stored in ROM 12. ROM 12 stores various programs. RAM 13 is used as a working memory when the process is executed by CPU 11. EEPROM 15 stores, for example, the preset information as a nonvolatile memory on which the data is electrically rewritable.

The user interface 17 has a display which is provided to display various pieces of information to a user who utilizes the printer 1, and an operation device which is provided to accept various pieces of operation information from the user to the printer 1.

The connection interface 19 is, for example, a USB interface which is provided to connect a personal computer 3 (hereinafter, referred to as a PC 3) to the printer 1. The connection interface 19 is constructed so that the printing instruction and the printing object data from PC 3 can be received.

When the printing instruction and the printing object data are received from PC 3 via the connection interface 19, then CPU 11 executes the printing control process (see FIG. 4, details will be described later on), and the instructions are inputted into the head controller 20 and the motor controller 30. Accordingly, the head controller 20 is allowed to execute the discharge control in relation to the ink liquid droplets to be discharged from the recording head 21, and the motor controller 30 is allowed to execute the transport control in relation to the carriage 41 and the printing paper Q in accordance with the control in relation to the CR motor 51 and the PF motor 81. According to the control as described above, the image, which is based on the printing object data as described above, is formed on the printing paper Q.

The recording head 21 is a well-known ink-jet head on which a plurality of nozzles for discharging the ink liquid droplets are arranged. The recording head 21 is driven by the driving circuit 23 to discharge the ink liquid droplets onto the printing paper Q opposed to the nozzle surface.

The head controller 20 inputs the control signal into the driving circuit 23 so that the image, which is based on the printing object data, is formed on the printing paper Q on the basis of the instruction from CPU 11. The head controller 20 realizes the discharge control in relation to the ink liquid droplets by means of the input of the control signal as described above.

On the other hand, the carriage transport mechanism 40 transports the carriage 41 which carries the recording head 21 in the main scanning direction by being driven by the CR motor 51. In this case, the main scanning direction corresponds to the normal line direction of the paper surface of FIG. 2. The carriage transport mechanism 40 is constructed such that the carriage 41 is supported by guide rails 45, 47 extending in the main scanning direction in the same manner as a well-known carriage transport mechanism.

Figure 2:
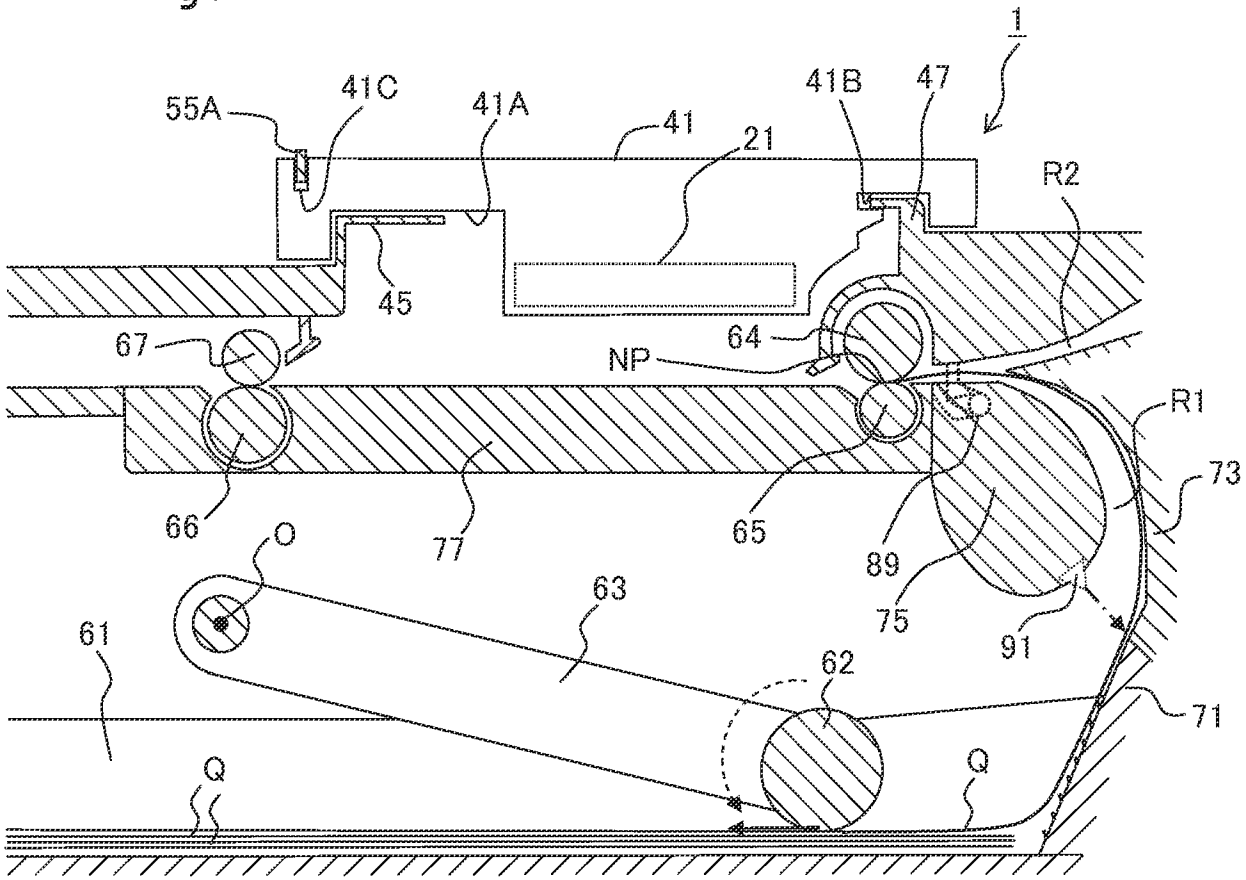
FIG. 2 shows an arrangement of a carriage transport mechanism 40 and a printing paper transport mechanism 60.

As shown in FIG. 2, grooves 41A, 41B, which extend in the main scanning direction, are formed on the lower surface of the carriage 41. The carriage 41 is installed on the guide rails 45, 47 such that the guide rails 45, 47 are inserted into the grooves 41A, 41B. The carriage 41 is movable in the main scanning direction while being restricted by the guide rails 45, 47. The carriage 41 receives the motive power from the CR motor 51 in the state in which the movement is restricted as described above, and thus the carriage 41 is reciprocatively moved in the main scanning direction. For example, the carriage 41 receives the motive power from the CR motor 51 by the aid of a known belt mechanism, and the carriage 41 is reciprocatively moved in the main scanning direction.

Further, a groove 41C, which extends in the main scanning direction, is formed on the upper surface portion of the carriage 41. An unillustrated optical sensor, which is capable of reading an encoder scale 55A, is fixedly arranged in the groove 41C. The linear encoder 55 described above (see FIG. 1) has the optical sensor and the encoder scale 55A inserted into the groove 41C.

The encoder scale 55A is provided independently from the carriage 41. Therefore, when the carriage 41 is moved in the main scanning direction, the relative position is changed between the encoder scale 55A and the optical sensor which is moved together with the carriage 41. The linear encoder 55 reads the scale of the encoder scale 55A by means of the optical sensor, and thus the pulse signal, which corresponds to the displacement of the carriage 41 in the main scanning direction, is outputted as the encoder signal.

The measuring circuit 57 (see FIG. 1) measures the position and the velocity of the carriage 41 in the main scanning direction on the basis of the encoder signal outputted from the linear encoder 55. The measured values of the position and the velocity are inputted into the motor controller 30.

The motor controller 30 has a CR motor controller 31 and a PF motor controller 35. The measured values of the position and the velocity of the carriage 41, which are supplied from the measuring circuit 57, are inputted into the CR motor controller 31. The transport control in relation to the carriage 41 is realized by the CR motor controller 31.

In particular, the CR motor controller 31 performs the transport control in relation to the carriage 41 in the main scanning direction in accordance with the closed loop control or a feedback control with respect to the CR motor 51 on the basis of the position and the velocity of the carriage 41 measured by the measuring circuit 57.

The CR motor controller 31 is operated in accordance with the instruction from CPU 11, and the CR motor controller 31 calculates the current command value corresponding to the difference or deviation between the measured value obtained by the measuring circuit 57 and the target value thereof. A PWM signal, which corresponds to the current command value, is inputted into the driving circuit 53 to control the CR motor 51 as the DC motor. The current, which corresponds to the duty ratio of the PWM signal, is inputted into the CR motor 51 by the driving circuit 53 in accordance with the PWM signal inputted from the CR motor controller 31 to drive the CR motor 51. In accordance with the flow as described above, the CR motor controller 31 realizes the transport control in relation to the carriage 41.

On the other hand, the PF motor controller 35 generates a PWM signal as the input signal for the driving circuit 83 in accordance with the instruction from CPU 11 to control the PF motor 81 as the DC motor. The current, which corresponds to the duty ratio of the PWM signal, is inputted into the PF motor 81 by the driving circuit 83 in accordance with the PWM signal inputted from the PF motor controller 35 to drive the PF motor 81. In accordance with the flow as described above, the PF motor controller 35 realizes the transport control in relation to the printing paper Q by the aid of the printing paper transport mechanism 60 (details will be described later on).

As shown in FIG. 2, the printing paper transport mechanism 60, which is operated by receiving the motive power from the PF motor 81, has rollers 62, 64, 65, 66, 67 each of which has an axis parallel to the main scanning direction.

The printing paper Q, which is placed on a paper feeding tray 61, is transported in the subsidiary scanning direction by the printing paper transport mechanism 60 in accordance with the rotation of the rollers 62, 64, 65, 66, 67. According to the transport operation, the printing paper Q is fed to the image forming position which is the discharge position of the ink liquid droplets to be discharged by the recording head 21, and the printing paper Q, on which the image is formed by the ink liquid droplets discharged from the recording head 21, is discharged to an unillustrated paper discharge tray.

In particular, the printing paper transport mechanism 60 has the paper feeding tray 61, a paper feed roller 62, an arm 63, a transporting roller 64, a pinch roller 65, a paper discharge roller 66, and a spur roller 67. Further, the printing paper transport mechanism 60 has a separation bank 71, a U-turn guide 73, a support member 75, and a platen 77 as the members for constructing the printing paper transport route.

A plurality of sheets of the printing paper Q are accommodated in a stacked state in the paper feeding tray 61. The arm 63 holds the paper feed roller 62 at the lower end portion in a rotatable state. The arm 63 has a rotational shaft O which is an axis of rotation disposed at a position (upper end portion) separated upwardly from the holding point of the paper feed roller 62, and the arm 63 is rotatable about the center of the rotational shaft O.

The arm 63 is rotated by the self-weight toward the bottom surface side of the paper feeding tray 61, and the paper feed roller 62 is allowed to abut against the surface of the printing paper Q accommodated by the paper feeding tray 61. The arm 63 may be constructed such that the paper feed roller 62 is allowed to abut against the surface of the printing paper Q accommodated by the paper feeding tray 61 by utilizing a force of a spring (not shown) in addition to the self-weight.

Figure 3A:
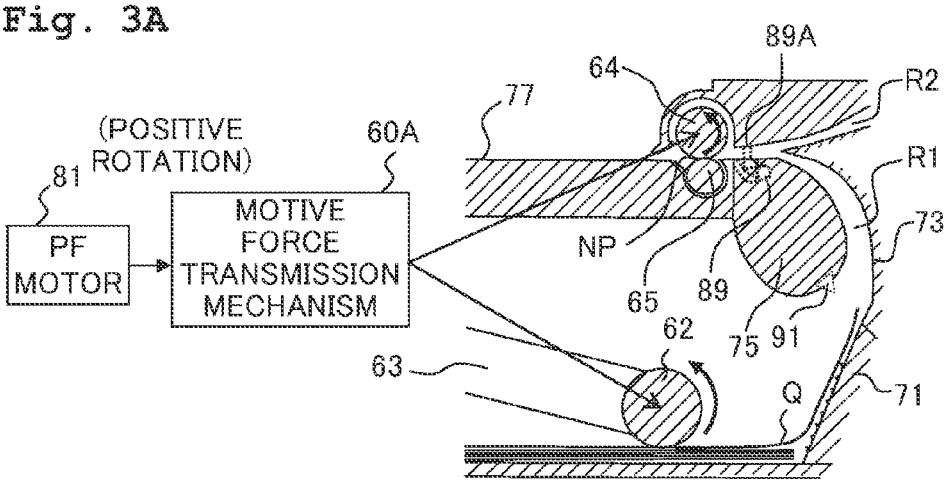
FIGS. 3A to 3C illustrate drawings in relation to a power transmission system from a PF motor 81.
Figure 3B:
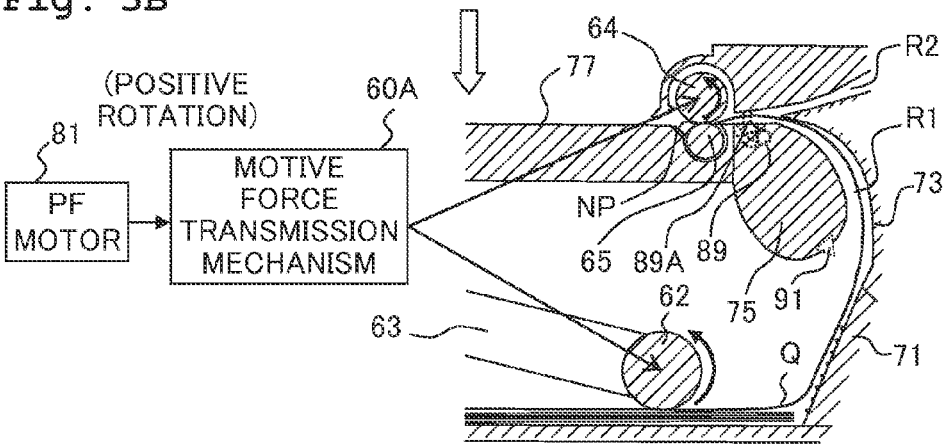
Figure 3C:
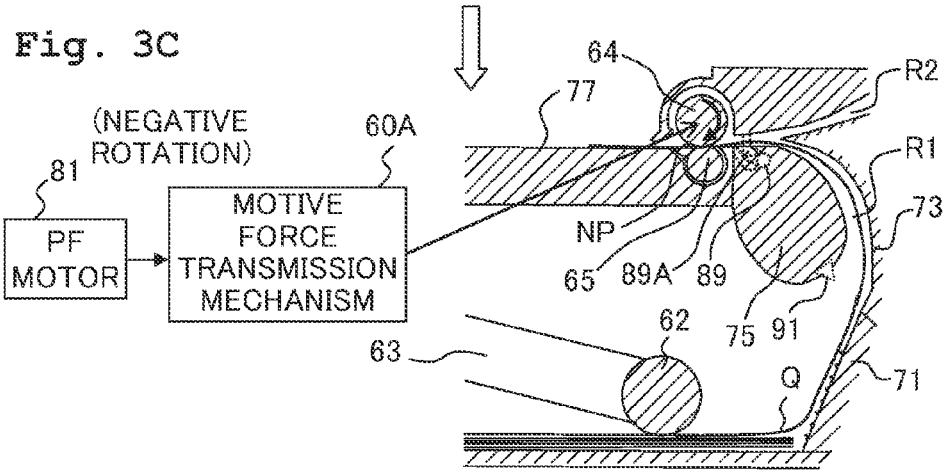

As shown in FIGS. 3A to 3C, the paper feed roller 62 is rotated by receiving the motive power from the PF motor 81 by the aid of a motive power transmission mechanism 60A (see FIG. 3) provided for the printing paper transport mechanism 60. As shown in FIGS. 3A and 3B, in the printing paper transport mechanism 60, the paper feed roller 62 is rotated positively (forwardly) in a state of being allowed to abut against the printing paper Q, and thus the force in the subsidiary scanning direction is allowed to act on the printing paper Q from the paper feed roller 62. Accordingly, the printing paper Q is fed from the paper feeding tray 61 to the printing paper transport passage. In this specification, the rotation of the rollers 62, 64, 65, 66, 67 in the direction of the transport of the printing paper Q to the downstream of the printing paper transport passage is especially expressed as "roller(s) is/are positively rotated". The positive rotation direction of the paper feed roller 62 is the direction of the thick line arrow depicted around the drawing area of the paper feed roller 62 in each of FIGS. 3A and 3B.

The printing paper Q, which is fed from the paper feeding tray 61 to the printing paper transport passage, passes through the upstream area of the printing paper transport passage constructed by the separation bank 71, and the printing paper Q enters the curved area R1 of the printing paper transport passage constructed by the U-turn guide 73 and the support member 75 as shown in FIG. 3A.

The separation bank 71 is provided in order to separate only one sheet of the printing paper Q disposed at the uppermost layer, of the plurality of sheets of the printing paper Q so that the plurality of sheets of the printing paper Q are not fed in an overlapped manner from the paper feeding tray 61. The separation bank 71 has pawls to suppress the overlapped feeding. As for the separation bank 71, a high friction member such as rubber or the like may be provided hi place of the pawl, in order to achieve the function to suppress the overlapped feeding.

The U-turn guide 73 is provided together with the support member 75 in order that the printing paper Q, which is transported from the upstream, is transported to a nip portion NP disposed between the transporting roller 64 and the pinch roller 65 positioned upwardly from the paper feeding tray 61 so that the printing paper Q is inverted. That is, the transport direction of the printing paper Q moving on the paper feeding tray 61 is inverted by the U-turn guide 73. The printing paper Q, which is transported from the paper feeding tray 61, is guided by the U-turn guide 73 and the support member 75, and the printing paper Q is transported to the nip portion NP disposed between the transporting roller 64 and the pinch roller 65 in a curved state as shown in FIG. 3B.

The support member 75 supports, from the lower position, the printing paper Q which is regulated for the movement by the U-turn guide 73 and which is transported while being curved, and the support member 75 guides the printing paper Q to the nip portion NP. The printer 1 of this embodiment has a transport route R2 for the printing paper Q from an unillustrated manual feeding tray. The curved area R1 and the transport route R2 merge at the position disposed over or above the support member 75. The support member 75 also supports, from the lower position, the printing paper Q moving via the manual feeding tray, and the support member 75 guides the printing paper Q to the nip portion NP.

A sensor 89 (so-called registration sensor), which is provided to detect that the forward end of the printing paper Q has passed to the downstream, is provided at an upper portion of the support member 75. The sensor 89 has a member 89A which is rotatable about the center of the axis parallel to the main scanning direction. The member 89A is rotated and pushed down in accordance with the action exerted from the printing paper Q transported from the upstream of the transport route.

FIG. 2 shows, with dotted lines, a state in which the member 89A is not pushed down and a state in which the member 89A is pushed down respectively. The sensor 89 outputs the high signal when the member 89A is in the state of being not pushed down, and the sensor 89 outputs the low signal when the member 89A is in the state of being pushed down (see FIG. 6D).

As shown in FIG. 1, the output signal (sensor signal), which is supplied from the sensor 89, is inputted into the PF motor controller 35. The printing paper Q is transported to the nip portion NP disposed at the downstream after undergoing the process in which the sensor 89 is pushed down.

On the other hand, the transporting roller 64 and the pinch roller 65 (see FIG. 2) are arranged opposingly so that they are brought in contact with each other. The nip portion NP is the contact point between the transporting roller 64 and the pinch roller 65.

The transporting roller 64 is rotated by receiving the motive power from the PF motor 81 by the aid of the motive power transmission mechanism 60A. The pinch roller 65 is rotated in a driven manner in accordance with the rotation of the transporting roller 64. When the paper feed roller 62 is positively rotated, and the printing paper Q is transported from the paper feeding tray 61 to the downstream of the printing paper transport passage, then the transporting roller 64 receives the motive power of the PF motor 81 by the aid of the motive power transmission mechanism 60A, and the transporting roller 64 is rotated (reversely rotated) in the opposite direction opposite to the positive rotation direction as shown in FIGS. 3A and 3B. The reverse rotation direction of the transporting roller 64 is the direction of the arrow depicted around the drawing area of the transporting roller 64 in each of FIGS. 3A and 3B.

As shown in FIG. 3B, the printing paper Q, which is transported from the paper feed roller 62, is prohibited from the movement to the downstream at the nip portion NP in accordance with the reverse rotation of the transporting roller 64, and the printing paper Q is allowed to abut against the nip portion NP. Any oblique travel of the printing paper Q is corrected in accordance with the abutment.

In accordance with the abutment, the printing paper Q is in such a state that the forward end is positionally adjusted in the vicinity of the nip portion NP in a state in which the printing paper Q is flexibly bent or warped along the U-turn guide 73. In this embodiment, the registration operation (referred to as "registration") is realized with respect to the printing paper Q in this way.

When the registration operation is completed in accordance with the abutment, then the rotating direction of the PF motor 81 is switched in accordance with the control on the PF motor controller 35, and thus the transporting roller 64 is positively rotated. In accordance with the positive rotation of the transporting roller 64, the printing paper Q is incorporated from the nip portion NP between the transporting roller 64 and the pinch roller 65 as shown in FIG. 3C, and the printing paper Q is transported to the downstream of the printing paper transport passage in a state of being interposed between the transporting roller 64 and the pinch roller 65.

In this specification, in relation to the direction of rotation of the PF motor 81, the direction in which the paper feed roller 62 is positively rotated, i.e., the direction in which the transporting roller 64 is reversely rotated is expressed as the "positive rotation" direction, and the direction in which the transporting roller 64 is positively rotated is expressed as the "negative rotation" direction. With reference to FIGS. 3A to 3C, it should be noticed that the direction in which the paper feed roller 62 is positively rotated is identical with the direction in which the transporting roller 64 is reversely rotated and that the definition of the "positive rotation" direction differs between the direction of rotation of the rollers 62, 64, 65, 66, 67 and the direction of rotation of the PF motor 81.

When the PF motor 81 is positively rotated, the motive power transmission mechanism 60A transmits the motive power of the PF motor 81 to both of the paper feed roller 62 and the transporting roller 64. On the other hand, when the PF motor 81 is negatively rotated, then the motive power is not transmitted to the paper feed roller 62, and the motive power is transmitted to the transporting roller 64. The motive power transmission mechanism 60A of this embodiment is constructed such that the motive power transmission route is switched depending on the direction of rotation of the PF motor 81 as described above.

The platen 77, which supports the printing paper Q, is provided at the downstream of the printing paper transport route from the position at which the transporting roller 64 and the pinch roller 65 are installed. The printing paper Q, which is transported to the downstream from the transporting roller 64, is moved to the downstream along the support surface of the platen 77. The recording head 21 discharges the ink liquid droplets onto the printing paper Q supported by the platen 77, and thus the image is formed on the printing paper Q.

Other than the above, as shown in FIG. 2, the paper discharge roller 66 and the spur roller 67 are arranged opposingly to one another at the downstream from the platen 77. The paper discharge roller 66 is connected to the transporting roller 64 by means of an unillustrated belt. In other words, when the transporting roller 64 is rotated, then the belt transmits the driving force thereof to the paper discharge roller 66, and the paper discharge roller 66 is rotated. Further, the spur roller 67 is rotated in a driven manner with respect to the paper discharge roller 66.

The printing paper Q, which is transported to the downstream along the platen 77, is interposed between the paper discharge roller 66 and the spur roller 67, and the printing paper Q is further transported to the downstream in accordance with the rotation of the paper discharge roller 66. After that, the printing paper Q is discharged to the paper discharge tray (not shown).

The rotary encoder 85, which is provided to observe the transport state of the printing paper Q in the printing paper transport mechanism 60, is installed in the motive power transmission route ranging from the PF motor 81 to the transporting roller 64 or coaxially with the transporting roller 64. The rotary encoder 85 is constructed to be capable of measuring the rotation amount of the PF motor 81 or the transporting roller 64.

Specifically, the rotary encoder 85 is constructed as the rotary encoder of the incremental type. The pulse signal (also referred to as an encoder signal), which corresponds to the rotation of the PF motor 81 or the transporting roller 64, is outputted from the rotary encoder 85. The output signal is inputted into the measuring circuit 87.

The measuring circuit 87 measures the rotation amount and the rotation velocity of the PF motor 81 on the basis of the encoder signal inputted from the rotary encoder 85. The measured values concerning the rotation amount and the rotation velocity are inputted into the PF motor controller 35.

In the printer 1 of this embodiment, the proportional relation holds in relation to the rotation amounts of the PF motor 81, the transporting roller 64, and the paper feed roller 62 in the state in which the motive power is transmitted from the PF motor 81. Therefore, in this embodiment, the explanation is made assuming that the measuring circuit 87 measures the rotation amount and the rotation velocity of the PF motor irrelevant to the position of installation of the rotary encoder 85.

The PF motor controller 35 realizes the transport control in relation to the printing paper Q by the paper feed roller 62, the transporting roller 64, and the paper discharge roller 66 in accordance with the closed loop control or the open loop control with respect to the PF motor 81 on the basis of the rotation amount and the rotation velocity of the PF motor 81 obtained from the measuring circuit 87. According to the printer 1 of this embodiment, the control on the PF motor 81 is switched from the closed loop control to the open loop control, if necessary. An explanation will be made below in a stepwise manner about the procedure of the control having the feature as described above and the construction of the printer 1 in order to realize the control.

Printing Control Process

Figure 4:
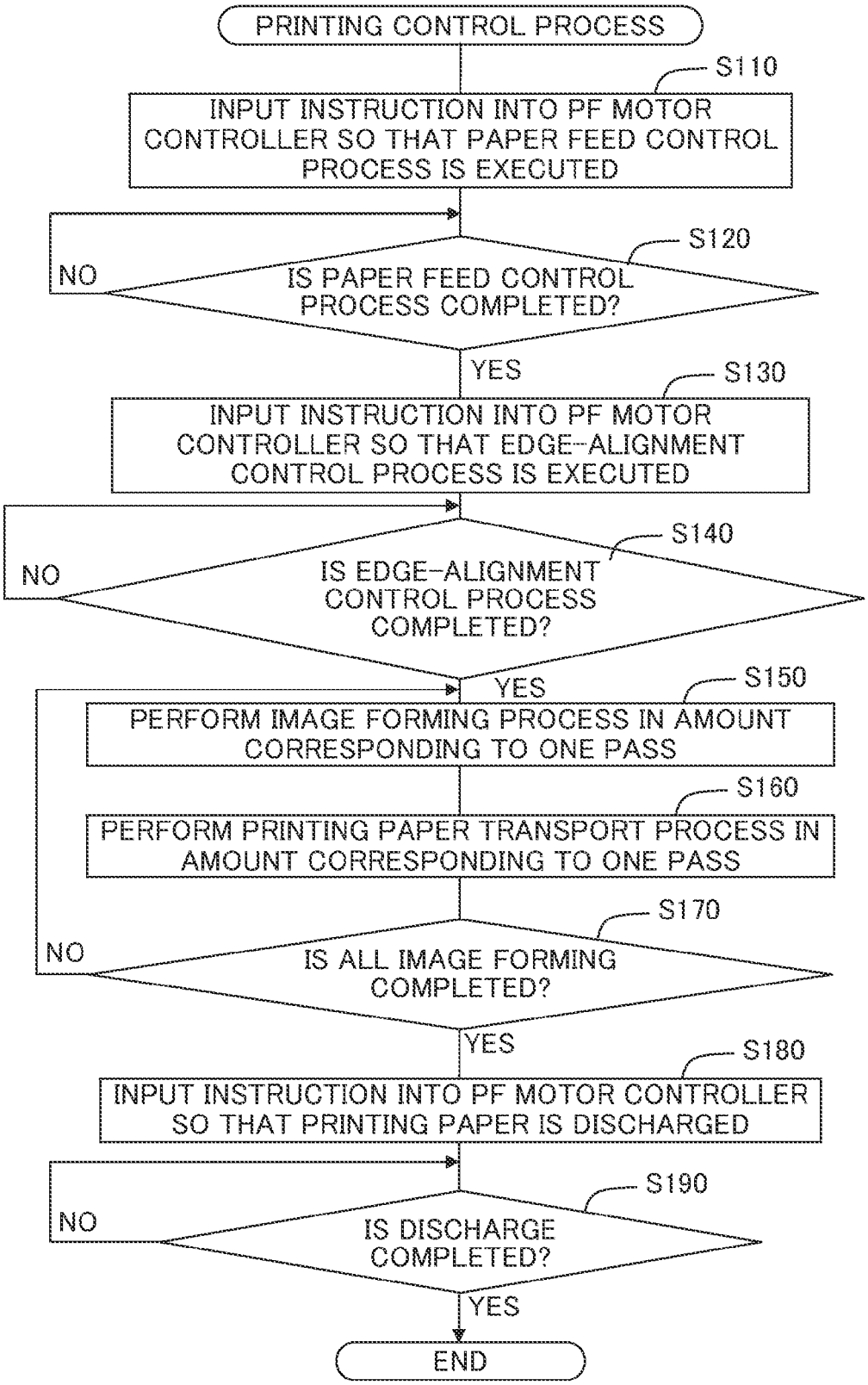
FIG. 4 shows a flow chart illustrating a printing control process executed by CPU 11.

An explanation will be firstly made with reference to FIG. 4 about details of the printing control process executed by CPU 11 when the printing instruction and the printing object data are received from PC 3. When an image is formed on the printing paper Q fed from the paper feeding tray 61, CPU 11 starts the printing control process shown in FIG. 4. When the printing object data is the data corresponding to a plurality of sheets of the printing paper, CPU 11 executes the printing control process for every one sheet of the printing paper.

When the printing control process is started, CPU 11 inputs the instruction into the PF motor controller 35 so that the paper feed control process is executed (Step S110, hereinafter simply referred to as "S110"). The paper feed control process is such a process that the rotation is controlled for the paper feed roller 62 and the transporting roller 64 by the aid of the PF motor 81 and one sheet of the printing paper Q is taken out thereby from the paper feeding tray 61 to transport the printing paper Q so that the printing paper Q abuts against the nip portion NP. According to this process, any oblique travel of the printing paper Q as the transport object is corrected, and the printing paper Q is positionally adjusted with respect to nip portion NP.

After the input of the instruction, CPU 11 waits until the paper feed control process is completed (S120). When the paper feed control process is completed (Yes in S120), the process proceeds to S130. In S130, CPU 11 inputs the instruction into the PF motor controller 35 so that the edge-alignment or document loading control process is executed. The edge-alignment control process is such a process that the rotation of the transporting roller 64 is controlled by the aid of the PF motor 81, and the printing paper Q is transported thereby from the nip portion NP to the downstream of the printing paper transport passage to realize the edge-alignment of the printing paper Q. As well-known, the edge-alignment is such an operation that the printing paper Q is transported so that the start point of the image forming object area of the printing paper Q is arranged at the position of ink liquid droplets discharge (referred to as an image forming position) performed by the recording head 21.

Whether or not the printing paper Q can be subjected to the edge-alignment at a high positional accuracy affects the quality of the image to be formed on the printing paper Q. The reason, why the positional adjustment (referred to as a registration operation) is performed for the printing paper Q before the edge-alignment, is that it is intended to make it possible to perform the edge-alignment of the printing paper Q at a high positional accuracy.

In S130, an operation is performed as an operation accompanied by the instruction input such that the rotation amount of the PF motor 81 (i.e., "edge-alignment amount"), which is required for the edge-alignment, is set for the PF motor controller 35. When the process in S130 is completed, CPU 11 waits until the edge-alignment control process by the PF motor controller 35 is completed (S140). When the edge-alignment control process is completed (Yes in S140), the image forming process, which corresponds to the amount of one pass, is executed (S150).

The image forming process, which corresponds to the amount of one pass as referred to herein, is the following process. That is, the instruction is inputted into the head controller 20 and the CR motor controller 31 to transport the carriage 41 by an amount of one way or an amount of one pass from the turnback point of the carriage transport passage corresponding to the present position to the turnback point at the downstream in the main scanning direction, while the recording head 21 discharges the ink liquid droplets to form the image in the area (area corresponding to the amount of one pass) of the printing paper Q over which the carriage 41 passes. In accordance with the image forming process, a line-shaped image (referred to as a line image) is formed in the main scanning direction in the area having a predetermined width in the subsidiary scanning direction as the area corresponding to the amount of one pass on the printing paper Q.

When the image forming process in the amount corresponding to one pass is completed, CPU 11 allows the process to proceed to S160 to execute the printing paper transport process corresponding to the amount of one pass. The printing paper transport process, which corresponds to the amount of one pas as referred to herein, is the following process. That is, CPU 11 inputs the instruction into the PF motor controller 35 to transport the printing paper Q to the downstream in the subsidiary scanning direction by the distance corresponding to the width in the subsidiary scanning direction (predetermined width described above) of the line image formed on the printing paper Q in the image forming process corresponding to the amount of one pass. In accordance with the input of the instruction, the PF motor controller 35 controls the rotation of the transporting roller 64 by the aid of the PF motor 81 to rotate the transporting roller 64 by the amount in which the printing paper Q is transported by the distance as described above. Accordingly, the printing paper Q is transported to the downstream in the amount corresponding to one pass.

CPU 11 repeatedly and alternately executes the image forming process corresponding to the amount of one pass and the printing paper transport process corresponding to the amount of one pass as described above to perform the image forming on the entire image forming object area of the printing paper Q (S150, S160, S170). When the image forming is completed for the entire image forming object area (Yes in S170), the PF motor 81 is controlled by the PF motor controller 35 so that the printing paper Q is discharged to the paper discharge tray, by means of the input of the instruction into the PF motor controller 35 (S180).

When the discharge of the printing paper Q is completed (Yes in S190), the concerning printing control process is completed. In the printer 1 of this embodiment, the printing control process of the contents as described above is executed. Subsequently, an explanation will be made with reference to FIG. 5 about details of the paper feed control process executed by the PF motor controller 35 in accordance with the instruction from CPU 11 (S110).

Paper Feed Control Process

When the paper feed control process is started, the PF motor controller 35 firstly starts the closed loop control with respect to the PF motor 81. In accordance with the start of the closed loop control, the PF motor controller 35 realizes the transport control in relation to the printing paper Q such that the paper feed roller 62 is positively rotated, one sheet of the printing paper Q is separated from the paper feeding tray 61 in accordance with the rotation, and the sheet of the printing paper Q is transported to the downstream of the printing paper transport passage (S210).

Specifically, in S210, the PF motor controller 35 calculates the difference or deviation $E=Xr-X$ between the rotation position X which is the measured value of the rotation amount of the PF motor 81 obtained from the measuring circuit 87 and the target position Xr which is the target value in relation to the rotation position X. As for the rotation position X, the origin ($X=0$) is the rotation position of the PF motor 81 provided immediately before the start of the paper feed control process, and the rotation position X corresponds to the rotation amount from the origin. The rotation position X is defined as the value which is increased in the positive direction when the PF motor 81 is rotated in the positive rotation direction.

Further, in S210, the PF motor controller 35 calculates the current command value U corresponding to the difference E. Specifically, the current command value U, which is in the direction to suppress the difference E to be zero, is calculated. For example, a PID controller (proportional-integral-differential controller) is used to calculate the current command value U. The PF motor controller 35 inputs, into the driving circuit 83, the PWM signal having the duty ratio corresponding to the current command value U, and thus the current corresponding to the current command value U is inputted into the PF motor 81. Accordingly, the PF motor 81 is positively rotated at the output corresponding to the load.

The PF motor controller 35 continuously executes the position control as the closed loop control on the PF motor 81 by repeating the procedures as described above until the forward end of the printing paper Q taken out of the paper feeding tray 61 passes through the position of installation of the sensor 89 (S210, S220).

That is, the PF motor controller 35 positively rotates the PF motor 81 to positively rotate the paper feed roller 62 so that the rotation position X of the PF motor 81 follows the target position locus in accordance with the closed loop control as described above. The target position locus is the locus of the target position Xr at the respective points in time (time T). Details of the target position locus will be described later on with reference to FIG. 6.

When the falling edge is detected in the output signal from the sensor 89 in accordance with the fact that the leading head of the printing paper Q passes through the installation position of the sensor 89 (Yes in S220), the PF motor controller 35 sets the completion position X1 which is the rotation position X for ending or completing the motor control in the paper feed control process (S230).

When the forward end of the printing paper Q passes through the installation position of the sensor 89, the output signal from the sensor 89 (referred to as a sensor signal) is switched from the high signal to the low signal. The falling edge, which is referred to herein, is the falling edge from the high signal to the low signal in accordance with the passage of the printing paper Q. The PF motor controller 35 detects the passage of the printing paper Q by detecting the falling edge (S220).

In S230, the value, which is obtained by adding a predetermined margin amount δX to the present rotation position X obtained from the measuring circuit 87, is set to the completion position X1=X+δX by the PF motor controller 35. The rotation amount D of the PF motor 81, which is provided as starting from the position of the printing paper Q at the point in time of the appearance of the falling edge as described above until the leading head of the printing paper Q arrives at the nip portion NP, is determined to be constant, if no slippage arises between the printing paper Q and the paper feed roller 62. Considering the slippage between the printing paper Q and the paper feed roller 62, the margin amount δX is determined to an amount larger than the rotation amount D by a certain constant amount δD.

That is, in S230, the PF motor controller 35 sets the completion position X1 in accordance with the paper feed control process so that the PF motor 81 is rotated by the amount X+D+δD=X+δX which is larger by a predetermined amount than the rotation amount (or the rotation position) X+D of the PF motor 81 required for the leading head of the printing paper Q to arrive at the nip portion NP, and the printing paper Q is transported by the amount of the distance corresponding to the rotation amount or the rotation position, i.e., the amount corresponding to X+δX.

After that, the control on the PF motor 81 is switched to the open loop control by the PF motor controller 35. Further, the PF motor controller 35 repeatedly executes the open loop control until the rotation position X obtained from the measuring circuit 87 exceeds the completion position X1 (S240, S250).

Specifically, in the open loop control, the PF motor controller 35 inputs the PWM signal having the duty ratio corresponding to a preset constant current command value U1 to the driving circuit 83, and thus a constant current corresponding to the current command value U1 is inputted into the PF motor 81. That is, in the open loop control, PF motor 81 is controlled so that the input current to be inputted into the PF motor 81 is retained at the fixed value.

The current command value U1 is determined by a designer on the basis of the upper limit value of the current capable of being inputted into the PF motor 81. For example, the current command value U1 is set to the upper limit value of the current capable of being inputted into the PF motor 81 or any value provided in the vicinity thereof. When the current command value U1 is set as described above, the PF motor 81 drives the paper feed roller 62 at an output of the upper limit or in the vicinity of the upper limit to transport the printing paper Q.

When the rotation position X obtained from the measuring circuit 87 exceeds the completion position X1 (Yes in S240), the PF motor controller 35 completes the concerning paper feed control process. CPU 11 is immediately informed of the completion of the paper feed control process.

FIG. 6 shows, for example, the target position locus to be used in the paper feed control process. The first part or uppermost part of FIG. 6 is a graph in which the horizontal axis represents the time T and the vertical axis represents the target position Xr. This graph shows, with a solid line, the outline of the target position locus to be used when the closed loop control is executed in the paper feed control process (S210, S220).

In this embodiment, the target position locus is unnecessary at points in time provided at and after the point in time at which the control on the PF motor 81 is switched to the open loop control. However, the first part of FIG. 6 shows, with a broken line, the target position locus when the closed loop control is continued as in the conventional technique, for the purpose of reference.

In fourth and fifth embodiments described later on, the switching from the closed loop control to the open loop control is not performed in some cases. In these embodiments, when the switching from the closed loop control to the open loop control is not performed, the closed loop control is performed in accordance with the target position locus indicated by the broken line in addition to the solid line.

The target position locus is set to such a locus that the forward end of the printing paper Q taken out of the paper feeding tray 61 arrives at the nip portion NP, the PF motor 81 is further rotated by the predetermined amount δD from this state in order to perform the registration operation, and then the rotation of the PF motor 81 is stopped and the rotation of the paper feed roller 62 is stopped.

Figure 6A:
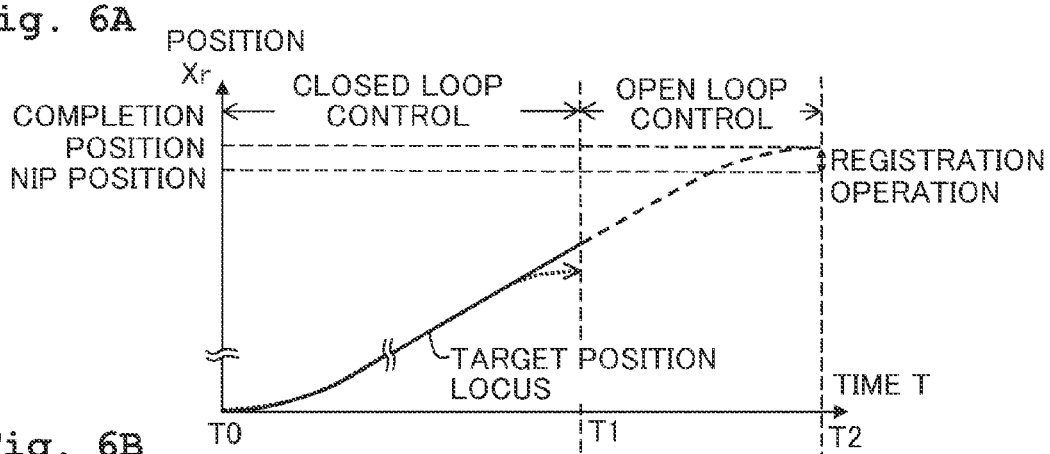
FIGS. 6A to 6D show a group of graphs illustrating, for example, the target position locus and the current command value in the paper feed control process.
Figure 6B:
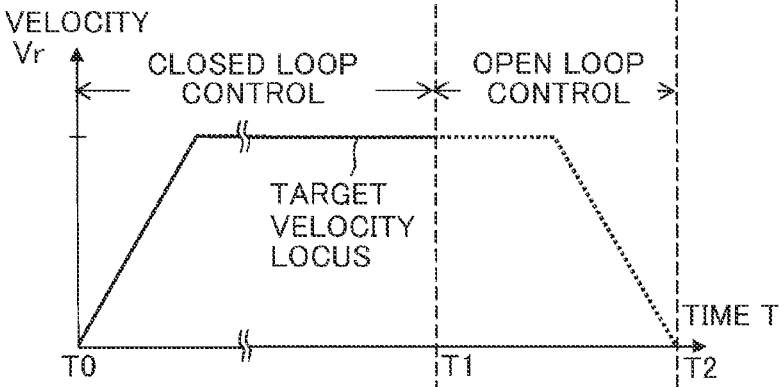

FIG. 6B shows a graph in which the horizontal axis represents the time T and the vertical axis represents the target velocity V. This graph shows, with a solid line, the outline of the target velocity locus which is the differentiation of the target position locus described above. The target velocity locus, which corresponds to a broken line portion of the target position locus, is also shown by a broken line in this graph in the same manner as described above. As can be understood from this drawing as well, the target position locus is set so that the PF motor 81 and the paper feed roller 62 are gradually accelerated and rotated from the point in time of the start of control and then the PF motor 81 and the paper feed roller 62 are rotated at constant velocities.

Figure 6C:
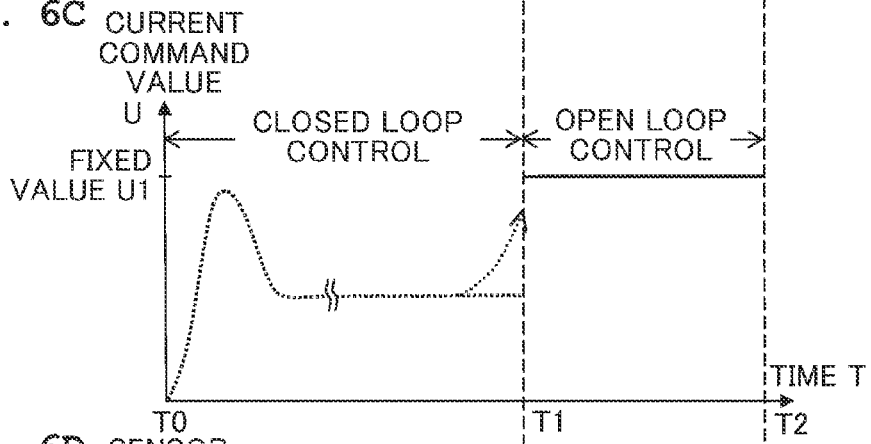

Other than the above, FIG. 6C shows a graph in which the horizontal axis represents the time T and the vertical axis represents the current command value U. This graph shows, with a broken line, an example of the current command value U calculated when the closed loop control is performed in accordance with the target position locus described above. Further, this graph shows, with a solid line, the current command value U during the period in which the open loop control is performed.

Figure 6D:
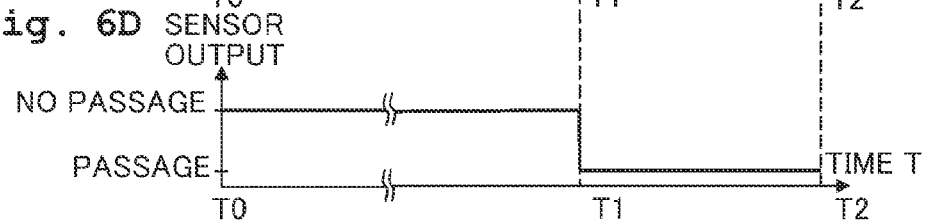

Further, FIG. 6D shows the time-dependent change of the output signal from the sensor 89 while the horizontal axis represents the time T. In the respective graphs shown in FIGS. 6A to 6D, the time T1 represents the point in time at which the forward end of the printing paper Q passes through the installation position of the sensor 89 and the falling edge appears in the output signal from the sensor 89, the time T0 represents the point in time of the start of the paper feed control process, and the time T2 represents the point in time of the completion.

As can be understood from the comparison between the graph shown in FIG. 6D and the graphs shown in FIGS. 6A to 6C, the PF motor controller 35 of this embodiment executes the open loop control as a part of the paper feed control process after the appearance of the falling edge in the output signal from the sensor 89 as a result of the passage of the forward end of the printing paper Q through the installation position of the sensor 89 until the rotation position of the PF motor 81 arrives at the completion position X1.

According to this operation, the PF motor controller 35 positively rotates the paper feed roller 62 and reversely rotates the transporting roller 64, and the printing paper Q is allowed to abut against the nip portion NP in this state. As shown in the middle part of FIG. 3, the forward end of the printing paper Q is positionally adjusted accurately with respect to the nip portion NP in the state in which the printing paper Q is flexibly bent or warped along the U-turn guide 73. The reason, why the control on the PF motor is switched from the closed loop control to the open loop control, will now be explained.

The printing paper transport passage of this embodiment is constructed to include the curved area R1. However, when the printer 1 is small-sized, the curvature is increased in the curved area R1. When the curvature is increased, the restoring force, which is generated when the printing paper Q intends to be restored from the bent state, is also increased. In this situation, the force, which acts on the U-turn guide 73 from the printing paper Q, is increased, i.e., the transport resistance of the printing paper Q is increased. Therefore, when the printer 1 is small-sized or miniaturized while being accompanied by the increase in the curvature, the load, which acts on the PF motor 81 during the printing paper transport, is increased. In other words, in the case of the printer 1 having the large curvature, the printing paper Q cannot be transported when the force, which is outputted by the PF motor 81, is not the force which is relatively larger than the force to be outputted by any PF motor 81 provided when the curvature is small.

According to this embodiment, the printing paper transport passage has the open space (for example, owing to the merging with the transport route R2 from the manual feeding tray) at the place at which the forward end of the printing paper Q passes through the curved area R1. Therefore, when the curvature of the curved area R1 is large, the load, which acts on the PF motor 81, is greatly lowered at the place at which the forward end of the printing paper Q passes through the curved area R1. The great decrease in the load as described above results in the fluctuation or vibration of the current command value U calculated in accordance with the closed loop control.

That is, when the load, which acts on the PF motor 81 when the printing paper Q is moved in the curved area R1, is large, a phenomenon may arise such that the rotation position X of the PF motor 81 is diverged from the target position Xr as indicated by a broken line arrow in FIG. 6A. If such a phenomenon occurs, the current command value U is also raised (see a broken line arrow in FIG. 6C).

On the other hand, it is assumed that the load is suddenly decreased at the place at which the printing paper Q passes through the curved area R1. In this case, the large current is inputted into the PF motor 81 in accordance with the closed loop control having been performed until now. Therefore, any excessive rotation consequently arises in the PF motor 81. A phenomenon (overshoot) arises such that the rotation position X obtained from the measuring circuit 87 is larger than the target position Xr.

When the phenomenon as described above arises, the current command value U and the input current to be inputted into the PF motor 81 are suddenly lowered in accordance with the closed loop control to suppress the difference E. In a state in which the input current to be inputted into the PF motor 81 is excessively lowered, the output of the PF motor 81 is consequently lower than the reaction force allowed to act in the opposite direction in relation to the transport direction of the printing paper Q, and the printing paper Q, which is being transported, is stopped.

When the printing paper Q is stopped during the transport as described above, then the frictional force, which is included in the reaction force, is changed from the kinetic frictional force to the static frictional force, and thus the force, which is required to transport the printing paper Q, is increased. In a case in which a small-sized motor, which has a low output, is used as the PF motor 81 to perform the transport control in relation to the printing paper Q, it is impossible to generate any force which is not less than the reaction force, and it is impossible to re-transport the printing paper Q in the stopped state.

Accordingly, in this embodiment, the control on the PF motor 81 is switched from the closed loop control to the open loop control at the point in time at which the forward end of the printing paper Q passes through the sensor 89 in order that the input current to be inputted into the PF motor 81 is not extremely lowered and the printing paper Q is not stopped due to the sudden load fluctuation around the outlet of the curved area R1 as described above.

According to the control as described above, it is possible to suppress the stop of the printing paper Q during the transport, which would be otherwise caused by the decrease in the input current to be inputted into the PF motor 81 as caused by the sudden decrease in the load. Therefore, when the printing paper Q is transported from the paper feeding tray 61 along the printing paper transport passage in which the load fluctuation is large as having the curved area R1 exhibiting the high curvature, it is possible to adequately transport the printing paper Q to the downstream by using the small-sized motor.

In relation thereto, the reason, why the closed loop control is executed without executing the open loop control at the initial stage of the transport of the printing paper Q from the paper feeding tray 61, is as follows. That is, in the case of the open loop control, it is impossible to adjust the input current for the PF motor 81 depending on the load, and the overlapped feeding of the printing paper Q or the like tends to arise.

According to this embodiment, the arm 63 rotatably retains the paper feed roller 62 at the lower end portion, and the arm 63 has the rotational shaft O at the upper end portion. According to the construction as described above, when the paper feed roller 62 is rotated in the direction indicated by the broken line arrow in FIG. 2, and the force acts on the printing paper Q from the paper feed roller 62 toward the downstream of the printing paper transport passage, then the force of reaction acts on the paper feed roller 62 from the printing paper Q as shown by the thick solid line arrow in FIG. 2. Accordingly, the arm 63 is rotated downwardly about the center of the rotational shaft O in accordance with the component force of the force of reaction. In other words, the pressurization arises with respect to the group of printing paper sheets on the paper feeding tray 61 from the paper feed roller 62 in accordance with the rotation of the arm 63 on which the force of reaction is allowed to act.

Therefore, when the input current to be inputted into the PF motor 81 is excessively larger than the adequate or proper value corresponding to the load when the printing paper Q is taken out of the paper feeding tray 61, the pressure, which is exerted on the printing paper group, is increased by the reaction. Further, the high pressure as described above causes, for example, the overlapped feeding of the printing paper. For the reason as described above, in this embodiment, the closed loop control is executed without executing the open loop control at the initial stage of the transport of the printing paper Q from the paper feeding tray 61.

Edge-Alignment Control Process

Figure 7:
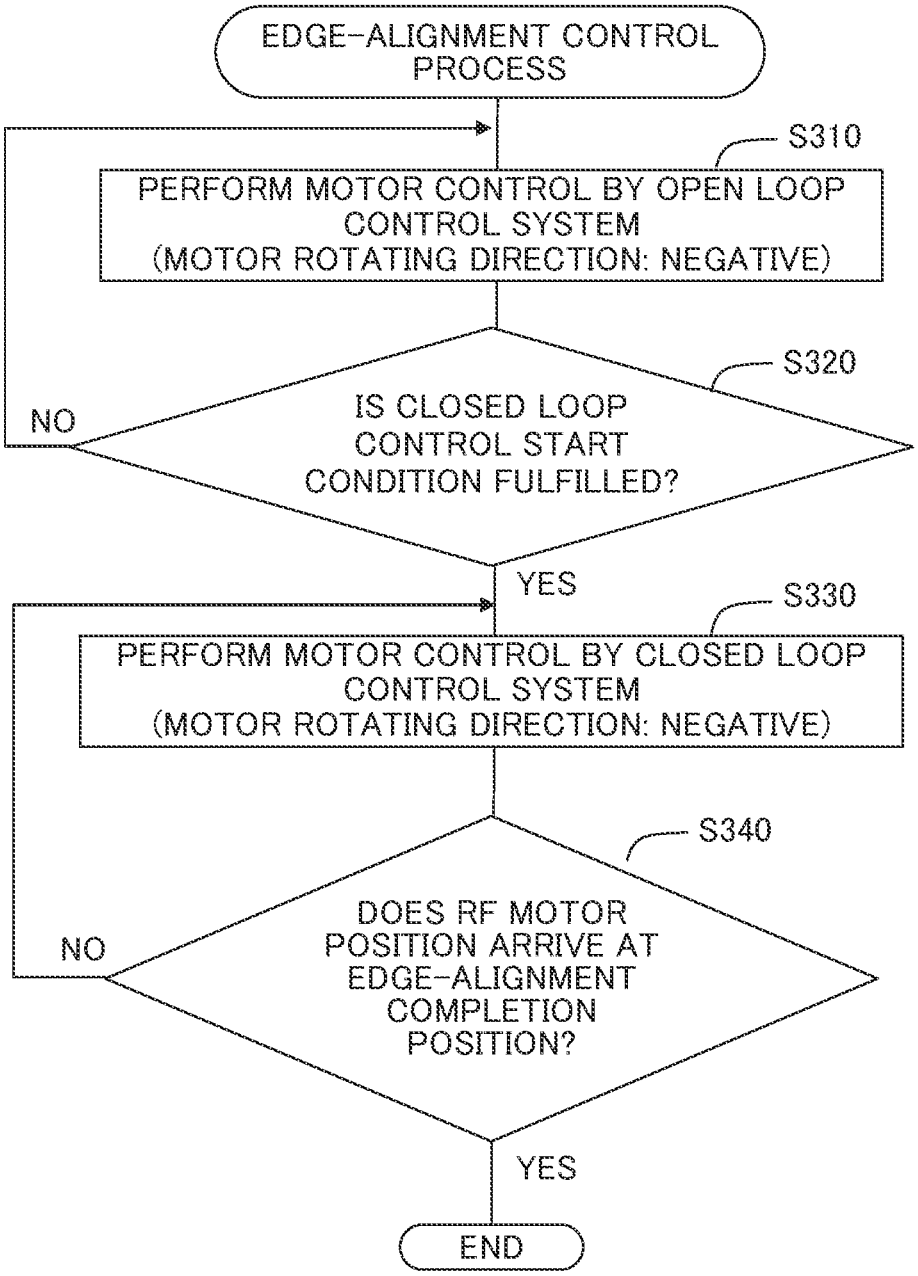
FIG. 7 shows a flow chart illustrating an edge-alignment control process executed by the PF motor controller 35.

Next, an explanation will be made with reference to FIG. 7 about details of the edge-alignment control process executed by the PF motor 35 in accordance with the instruction from CPU 11 (S130). The edge-alignment control process is immediately executed after the paper feed control process on the basis of the instruction from CPU 11.

When the edge-alignment control process is started, the PF motor controller 35 switches the rotating direction of the PF motor 81 from the positive rotating direction having been provided during the paper feed control process to the negative rotating direction to execute the open loop control on the PF motor 81. Accordingly, the transporting roller 64 is positively rotated to realize the intake of the printing paper Q from the nip portion NP (S310).

In this embodiment, when the current command value U is a positive value, the current, which is in the direction to positively rotate the PF motor 81, is inputted into the PF motor 81, while when the current command value U is a negative value, the current, which is in the direction to negatively rotate the PF motor 81, is inputted into the PF motor 81. The operation, in which the rotating direction of the PF motor 81 of this embodiment is switched from the positive rotating direction to the negative rotating direction, is realized by the operation in which the current command value U is switched to the negative value.

In the open loop control, the current command value U2 (absolute value) is used, which is smaller than the current command value U1 (absolute value) used in the paper feed control process. That is, in S310, the PWM signal, which has the duty ratio corresponding to the current command value U2, is inputted into the driving circuit 83, and thus the PF motor 81 is controlled so that the input current to be inputted into the PF motor 81 is retained at the fixed value corresponding to the current command value U2.

The current command value U2 can be arbitrarily determined by a designer. However, the reason, why the current command value U2 (absolute value) is smaller than the current command value U1 (absolute value) in the edge-alignment control process, is as follows. That is, in the case of the current command value U1 which is set in the vicinity of the upper limit value of the current capable of being inputted into the PF motor 81, the output is too high. When the current command value U1 is used for the edge-alignment control, there is such a possibility that the transporting roller 64 may cause any slippage with respect to the printing paper Q during the intake of the printing paper Q from the nip portion NP. It is preferable that the designer determines the current command value U2 so that any slippage is not caused.

The open loop control, which is based on the use of the current command value U2 as described above, is repeatedly executed by the PF motor controller 35 until the closed loop control start condition is fulfilled (S310, S320). When the closed loop control start condition is fulfilled (Yes in S320), the control on the PF motor 81 is switched from the open loop control to the closed loop control.

The closed loop control start condition is determined by setting the closed loop control start position Z0 to the rotation position provided before the rotation position (edge-alignment amount) Z1 of the PF motor 81 to be realized by the curing control process, by the amount required to decelerate and stop the PF motor 81.

That is, the PF motor controller 35 executes the open loop control until the rotation position Z of the PF motor 81, which is obtained from the measuring circuit 87, exceeds the closed loop control start position Z0. When the rotation position Z exceeds the closed loop control start position Z0, it is judged that the closed loop control start condition is fulfilled.

As for the rotation position Z used herein, the origin (Z=0) is the rotation position of the PF motor 81 provided immediately before the start of the edge-alignment control process, and the rotation position Z corresponds to the rotation amount from the origin. The rotating direction of the PF motor 81 differs between the paper feed control process and the edge-alignment control process. However, the rotation position Z is defined as the value which increases in the positive direction when the PF motor 81 is rotated in the negative rotation direction.

When the PF motor controller 35 judges that the closed loop control start condition is fulfilled by the fact that the rotation position Z of the PF motor 81 obtained from the measuring circuit 87 exceeds the closed loop control start position Z0 (Yes in S320), then the PF motor controller 35 executes the closed loop control on the PF motor 81 so that the PF motor 81 is rotated in accordance with the target position locus (S340), and the printing paper Q is subjected to the edge-alignment highly accurately.

Figure 8A:
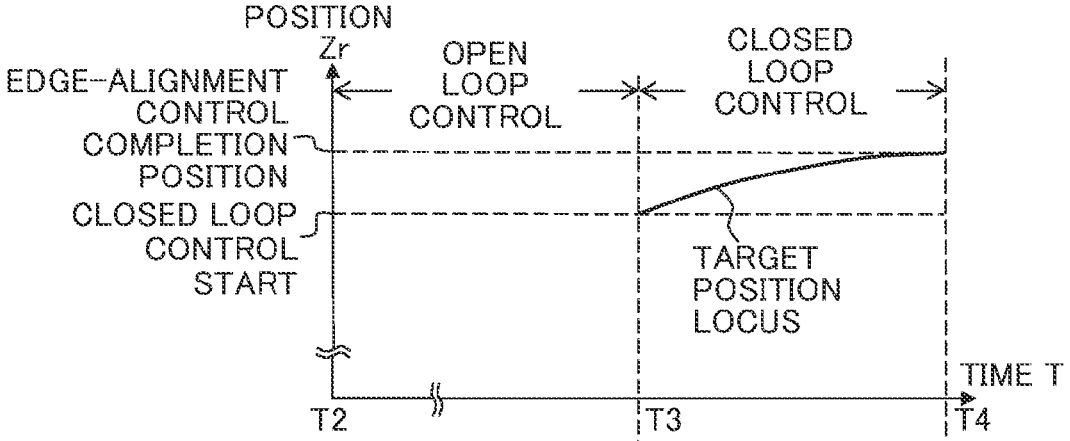
FIGS. 8A and 8B show a group of graphs illustrating, for example, the target position locus and the current command value in the edge-alignment control process.
Figure 8B:
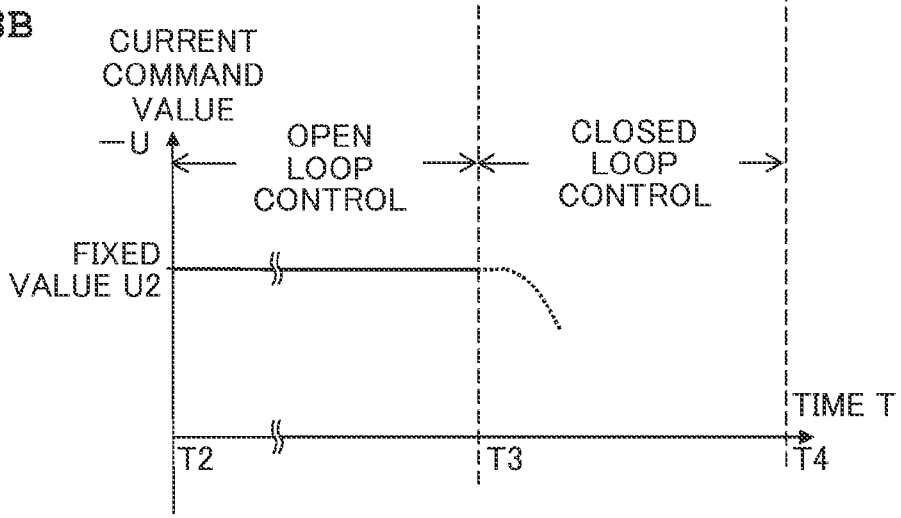

The target position locus, which is used in the edge-alignment control process, is as shown in the upper part of FIG. 8. The target position locus represents the target position Zr as the target value of the rotation position Z at the respective points in time (time T) on the basis of the point in time of the switching to the closed loop control. The target position Zr, which is provided at the switching point in time, is set, for example, to the closed loop control start position Z0. Further, the target position Zr, which is provided at the point in time of the completion of the edge-alignment control, is set to the rotation position Z1 corresponding to the curing amount Z1.

The current command value U is retained at the constant value (current command value U2) in the open loop control. However, the current command value U is adjusted to the value corresponding to the load as shown by the broken line in FIG. 8B after the switching point in time to the closed loop control. In the graph shown in FIG. 8B, the upward direction of the vertical axis is set as the negative direction of the current command value U. In the respective graphs shown in FIGS. 8A and 8B, the start point in time of the edge-alignment control process is represented by the time T2, and the completion point in time is represented by the time T4. Further, the switching point in time to the closed loop control is represented by the time T3.

The PF motor controller 35 executes the closed loop control in accordance with the target position locus until the rotation position Z of the PF motor 81 arrives at the position Z1 (S330, S340). When the rotation position Z of the PF motor 81 arrives at the position Z1 (Yes in S340), the edge-alignment control process is completed.

The reason, why the control on the PF motor 81 is switched from the open loop control to the closed loop control, will now be explained. In the registration operation, the current command value U is the value which is set to the upper limit value of the current capable of being inputted into the PF motor 81 or the value in the vicinity thereof as described above. Therefore, the large force acts on the printing paper Q from the paper feed roller 62. On the other hand, in the registration operation, the transporting roller 64 is reversely rotated. Therefore, the printing paper Q is flexibly bent or warped in the area of the printing paper transport passage in which the U-turn guide 73 is arranged. In other words, the printing paper Q is flexibly bent by being pushed toward the downstream of the printing paper transport passage by means of the large force exerted by the paper feed roller 62. Therefore, the printing paper Q has the large restoring force when the registration operation is completed. The restoring force is more increased when the curvature of the printing paper transport passage is increased and/or when the printing paper Q is a thick sheet of paper such as a glossy paper sheet or the like.

When the PF motor controller 35 positively rotates the transporting roller 64 to start the edge-alignment control process in the state in which the printing paper Q has the large restoring force, the restoring force possessed by the printing paper Q is released in the transport direction. In this situation, when the start of the edge-alignment control process is executed in accordance with the closed loop control, any excessive rotation arises in the PF motor 81. Therefore, the rotation position Z is larger than the target position Zr. When such a phenomenon arises, the input signal to be inputted into the PF motor 81 is excessively lowered in accordance with the closed loop control to suppress the difference E. In other words, the printing paper Q which is being transported is stopped. In the next place, when the printing paper Q is stopped, the rotation position Z is lower than the target position Zr. Therefore, the input current to be inputted into the PF motor 81 is excessively raised in accordance with the closed loop control to suppress the difference E. In other words, when it is intended to realize the edge-alignment control process by means of the closed loop control, then the current command value U is fluctuated or vibrated, and it is impossible to perform the edge-alignment for the printing paper Q highly accurately.

When the registration operation is completed in the state in which the printing paper Q has the large restoring force, the following phenomenon occurs in some cases. The printing paper Q is pushed by the large force exerted by the paper feed roller 62, and hence the printing paper Q is excessively pushed into the nip portion NP. Accordingly, when the registration operation is completed, the forward end of the printing paper Q is moved by a minute amount to the upstream from the nip portion NP on account of the restoring force of the printing paper Q. In this situation, the transporting roller 64 is reversely rotated due to the friction with the printing paper Q which is moved by the minute amount. This phenomenon arises when the printing paper Q is a glossy paper sheet having the frictional resistance larger than that of the regular paper or when the printing paper Q is a thick sheet of paper.

A period of time, in which the rotation position Z of the PF motor 81 is not increased, exists at the initial stage of the edge-alignment control process. Accordingly, when the start of the edge-alignment control process is executed in accordance with the closed loop control, then the rotation position Z is below the target position Zr, and hence the input current to be inputted into the PF motor 81 is excessively raised in accordance with the closed loop control to suppress the difference E. After that, the printing paper Q quickly advances in the course of time, and thus the rotation position Z is larger than the target position Zr. Therefore, the input current is excessively lowered. In other words, when it is intended to realize the edge-alignment control process by means of the closed loop control, then the current command value U is vibrated, and it is impossible to perform the edge-alignment for the printing paper Q highly accurately.

As described above, when the start of the edge-alignment control process is executed by means of the closed loop control, then the current command value U is vibrated, and it is impossible to perform the edge-alignment for the printing paper Q highly accurately. Accordingly, in this embodiment, in order to stabilize the transport state of the printing paper Q as affected by the vibration of the current command value U resulting from the restoring force of the printing paper Q as described above, the start of the edge-alignment control process is executed by means of the open loop control in relation to the PF motor 81. According to the control as described above, the current command value U is not vibrated, i.e., the transport state of the printing paper Q is stabilized as compared with the closed loop control, and it is possible to achieve the highly accurate edge-alignment.

The printer 1 of this embodiment has been explained above. According to this embodiment, the closed loop control is executed at the initial stage of the transport of the printing paper Q from the paper feeding tray 61. Therefore, it is possible to suppress the overlapped feeding of the printing paper Q from the paper feeding tray 61, and it is possible to adequately realize the transport control in relation to the printing paper Q from the paper feeding tray 61.

Further, according to this embodiment, the open loop control is executed for the PF motor 81 from the point in time at which the forward end of the printing paper Q passes through the sensor 89 positioned at the downstream side end portion of the curved area R1. Therefore, the stop of the printing paper Q during the transport, which is caused by being defeated by the reaction force, can be suppressed, which would be otherwise caused such that the sudden decrease in the load arises around the downstream side end portion of the curved area R1 and this causes the sudden decrease in the input current to be inputted into the PF motor as caused when the closed loop control is continued without performing the switching to the open loop control.

That is, according to this embodiment, even when the sudden decrease in the load arises around the downstream side end portion of the curved area R1, then the stop of the printing paper Q during the transport can be suppressed, and it is possible to adequately perform the positional adjustment (referred to as the registration operation) of the printing paper Q with respect to the nip portion NP.

Further, according to this embodiment, the high speed transport of the printing paper Q is realized in accordance with the open loop control upon the start of the edge-alignment control process. The open loop control is switched to the closed loop control at the later stage of the edge-alignment control process, and thus the correct edge-alignment of the printing paper Q is realized. Therefore, according to this embodiment, it is possible to produce the small-sized printer 1 having the high performance.

In the meantime, the exemplary case has been described above, wherein the control on the PF motor 81 is switched to the closed loop control when the remaining transport amount of the printing paper Q arrives at the predetermined transport amount in accordance with the edge-alignment control process as the rotation position Z of the PF motor 81 arrives at the closed loop control start position Z0. However, the judgment to judge whether or not the closed loop control start condition is fulfilled in S320 may be realized in accordance with the following judgment.

That is, the PF motor controller 35 may be constructed as follows. When the PF motor 81 is rotated by a predetermined amount from the start of the edge-alignment control process, i.e., when the printing paper Q is transported by a predetermined amount, then the PF motor controller 35 judges that the closed loop control start condition is fulfilled (Yes in S320), and the control on the PF motor 81 is switched to the closed loop control (S330).

Other than the above, the PF motor controller 35 may be constructed as follows. When a predetermined time elapses after the start of the edge-alignment control process, then the PF motor controller 35 judges that the closed loop control start condition is fulfilled (Yes in S320), and the control on the PF motor 81 is switched to the closed loop control (S330).

The predetermined amount and the predetermined time, which are referred to herein, can be determined as the amount and the time with which the closed loop control is started at the timing equivalent to that of the exemplary case in which the closed loop control is started at the closed loop control start position Z0 described above or any timing earlier than the above. The position Z0, the predetermined amount, and the predetermined time, which are used when the open loop control is switched to the closed loop control, are appropriately determined by a designer at the designing stage so that it is possible to avoid the unstable state caused by the restoring force of the printing paper Q after the start of the curing control process as described above.

Alternatively, the switching between the closed loop control and the open loop control can be also realized such that the current command values U are calculated in parallel by means of the closed loop control system and the open loop control system, while the object, for which the conversion is performed into the PWM signal, is selected as one of the current command values U calculated by the closed loop control system and the open loop control system.

Figure 9:
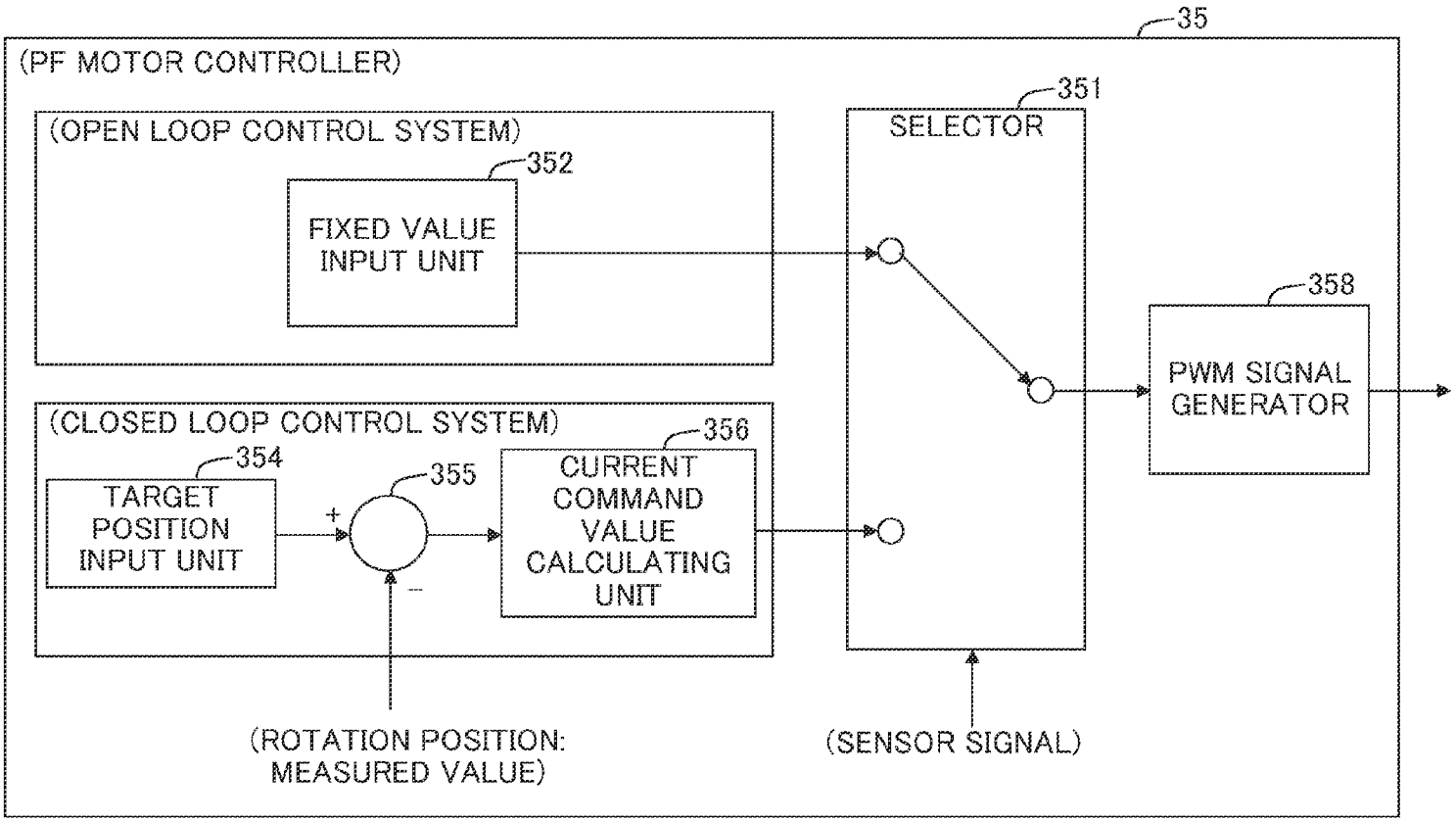
FIG. 9 shows a functional block diagram illustrating an arrangement of a PF motor controller 35 in a modified embodiment.

That is, the PF motor controller 35 may be constructed as follows as shown in FIG. 9. The PF motor controller 35 has a selector 351 which selectively inputs, into a PWM signal generator 358, one of the current command values U calculated by the closed loop control system and the open loop control system.

According to the example shown in FIG. 9, the PF motor controller 35 has, as an open loop control system, a fixed value input unit 352 which inputs fixed current command values U1, U2 into the selector 351. Further, the PF motor controller 35 has, as a closed loop control system, a target position input unit 354, a difference calculating unit 355, and a current command value calculating unit 356. According to this closed loop control system, the difference calculating unit 355 calculates the difference or deviation E=Xr−X between the target position Xr inputted from the target position input unit 354 and the rotation position X inputted from the measuring circuit 87, and the difference E is inputted into the current command value calculating unit 356.

The difference E, which is inputted from the difference calculating unit 355, is inputted into a predetermined transfer function by the current command value calculating unit 356 to calculate the current command value U in the direction in which the difference E is suppressed to be zero, and the current command value U is inputted into the selector 351. One of the current command values inputted from both of the fixed value input unit 352 and the current command value calculating unit 356 is selectively inputted into the PWM signal generator 358 by the selector 351. The PWM signal generator 358 generates the PWM signal having the duty ratio corresponding to the inputted current command value U, and the PWM signal is inputted into the driving circuit 83.

According to the construction of the printer 1 as described above, it is also possible to obtain the effect which is the same as or equivalent to that of the embodiment described above.

Second Embodiment

Next, a printer 1 of a second embodiment will be explained. However, the printer 1 of the second embodiment is constructed in the same manner as the printer 1 of the first embodiment except that a sensor 91 (see FIG. 2) is provided at an upstream side end portion of the curved area R1 and the contents of the paper feed control process are different from those of the first embodiment. Therefore, the construction, which is different from that of the first embodiment, will be selectively explained below as the explanation about the printer 1 of the second embodiment.

In the first embodiment, taking the opportunity of the detection of the printing paper forward end by the sensor 89 as the so-called registration sensor, the control on the PF motor 81 is switched from the closed loop control to the open loop control. The sudden load fluctuation, which is the reason to perform the switching of the control as described above, is caused while taking the opportunity of the entrance or advance of the printing paper Q into the curved area R1 to cause the increase in the load exerted on the PF motor 81.

The reason, why the closed loop control is performed at the initial stage of the printing paper transport process in accordance with the paper feed control process, is that the printing paper Q is taken out of the paper feeding tray 61 adequately. No problem arises even when the open loop control is performed without performing the closed loop control after the forward end of the printing paper Q passes along the separation bank 71 to the downstream and the printing paper Q is completely separated from the group of other sheets of the printing paper accommodated by the paper feeding tray 61.

Other than the above, one of the causes of the sudden load fluctuation is, for example, the slippage of the printing paper Q. For example, when the printing paper Q causes the slippage with respect to the paper feed roller 62, the load is suddenly decreased. On the other hand, the force, which is required to flexibly bend or warp the printing paper Q, is suddenly increased and the load is increased around the point or place at which the horizontal direction component of the movement vector of the printing paper Q is inverted in the curved area R1. Therefore, the sudden load fluctuation may also arise depending on the thickness of the printing paper Q and/or the curvature of the curved area R1 at the point in time at which the forward end of the printing paper Q passes through the separation bank 71 and/or around the point or place at which the movement vector of the printing paper Q is directed vertically upwardly in the curved area R1.

In view of the above, in this embodiment, the sensor 91 (for example, an optical sensor), which is capable of detecting the passage of the forward end of the printing paper Q, is separately attached to the upstream side end portion of the curved area R1. Taking the opportunity of the passage of the forward end of the printing paper Q through the upstream side end portion of the curved area R1, the control on the PF motor 81 is switched from the closed loop control to the open loop control. The sensor 91 is shown by dotted lines in FIG. 2. The detection position for the printing paper forward end to be detected by the sensor 91 is indicated by an alternate long and short dash line arrow.

Figure 5:
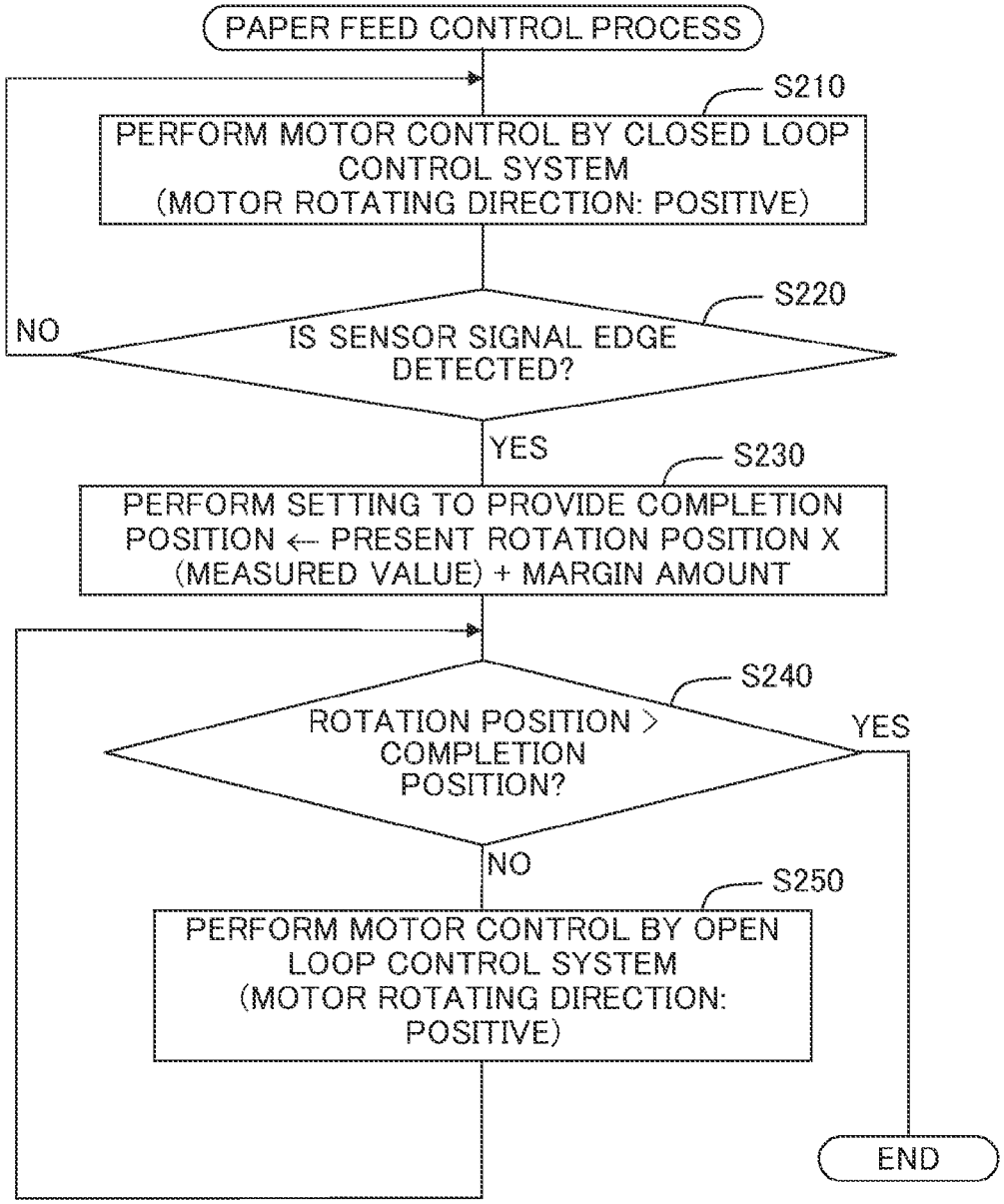
FIG. 5 shows a flow chart illustrating a paper feed control process executed by a PF motor controller 35.
Figure 10:
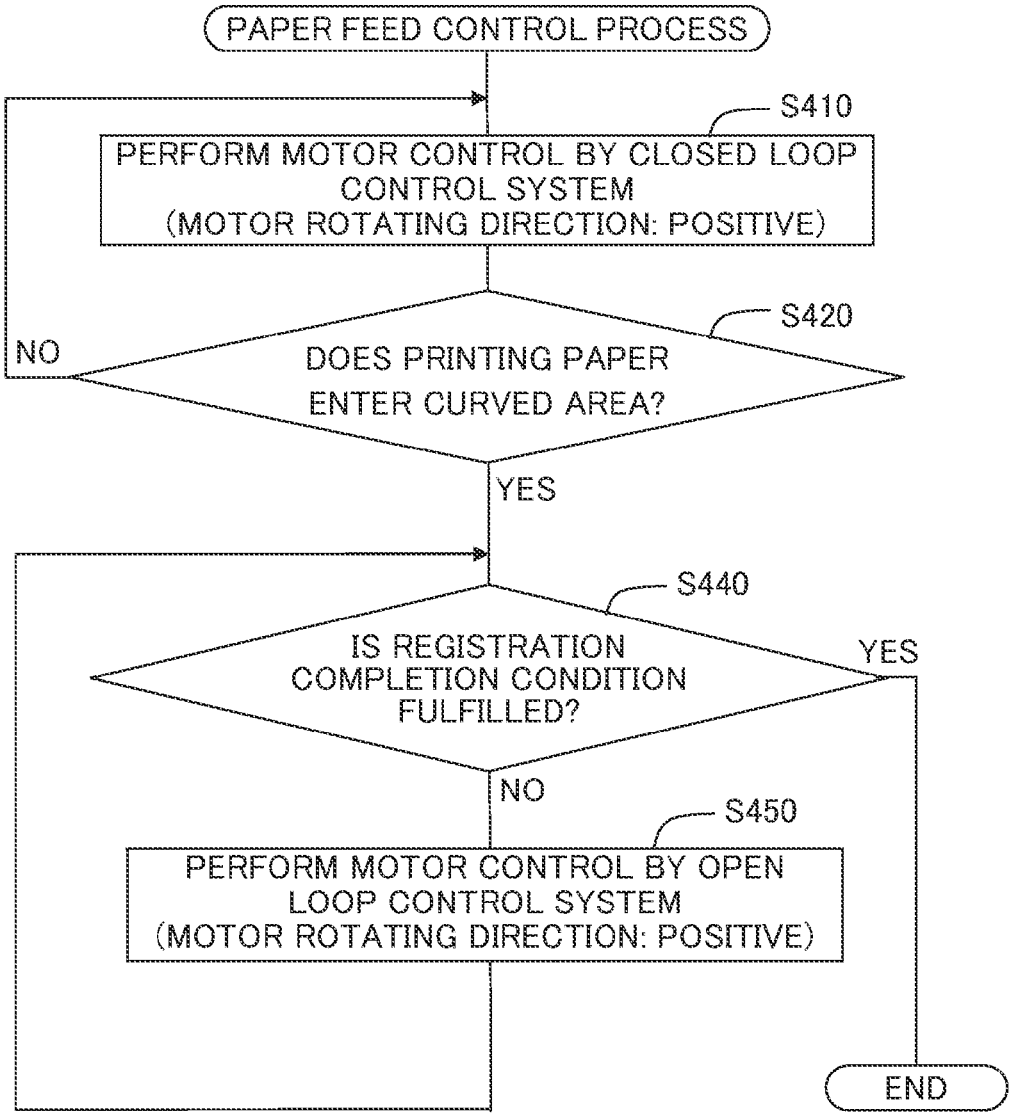
FIG. 10 shows a flow chart illustrating a paper feed control process in a second embodiment.

Specifically, the PF motor controller 35 of this embodiment executes the paper feed control process shown in FIG. 10 in place of FIG. 5 in accordance with the instruction from CPU 11 (S110). When the paper feed control process is started, the PF motor controller 35 executes the closed loop control on the PF motor 81 in the same manner as in Step S210 of the first embodiment. Accordingly, the paper feed roller 62 is positively rotated. In accordance with this rotation, the transport control on the printing paper Q is realized such that one sheet of the printing paper Q is separated from the paper feeding tray 61 and the sheet of the printing paper Q is transported to the downstream of the printing paper transport passage (S410).

That is, the PF motor controller 35 continuously executes the calculation of the current command value U based on the difference E and the output of the PWM signal based on the current command value U until the printing paper Q is taken out of the paper feeding tray 61 and the forward end of the printing paper Q enters the curved area R1 and passes through the installation position of the sensor 91 (S410, S420).

When it is judged that the leading head of the printing paper Q passes through the installation position of the sensor 91 on the basis of the output signal of the sensor 91 (Yes in S420), the PF motor controller 35 performs the open loop control on the PF motor 81 until the predetermined registration completion condition is fulfilled (S440, S450).

In the open loop control, the PF motor controller 35 outputs the PWM signal corresponding to the current command value U1 in the same manner as in the process in S250, and thus the PF motor 81 is controlled so that the input current to be inputted into the PF motor 81 is retained at the fixed value. Further, when the predetermined registration completion condition is fulfilled (Yes in S440), the concerning paper feed control process is completed.

The same registration completion condition as that of the first embodiment can be adopted. That is, it is possible to provide the following construction. The PF motor controller 35 sets the completion position X1=X+δX by adding the predetermined margin amount δX to the rotation position X obtained at the point in time, while the forward end of the printing paper Q passes through the installation position of the sensor 89 at the point in time, and the open loop control is repeatedly executed until the rotation position X obtained from the measuring circuit 87 exceeds the completion position X1 (S440, S450). When the rotation position X obtained from the measuring circuit 87 exceeds the completion position X1, then the PF motor controller 35 judges that the registration completion condition is fulfilled (Yes in S440), and the paper feed control process is appropriately completed.

Other than the above, the following condition may be set as the registration completion condition. That is, it is possible to provide the following construction. The PF motor controller 35 repeatedly executes the open loop control until the integrated value of the input current to be inputted into the PF motor 81 arrives at a preset upper limit value after the printing paper Q arrives at the transporting roller 64 (nip portion NP). When the integrated value of the input current to be inputted into the PF motor 81 arrives at the preset upper limit value, then it is judged that the registration completion condition is fulfilled (Yes in S440), and the paper feed control process is completed.

The integrated value of the input current to be inputted into the PF motor 81 can be determined, for example, by calculating the integrated value (added-up value) of the current command value U from the point in time at which it is estimated that the printing paper Q arrives at the nip portion NP, on the basis of the rotation position X obtained from the measuring circuit 87.

The printer 1 of the second embodiment has been explained above. According to the printer 1 of this embodiment, even when any sudden load fluctuation arises at or after the point in time at which the printing paper Q enters the curved area R1, it is possible to suppress the stop of the printing paper Q which is being transported. That is, according to this embodiment, it is possible to suppress the stop of the printing paper Q which is being transported, in the wider area of the printing paper transport passage. It is possible to appropriately perform the positional adjustment (referred to as the registration operation) of the printing paper Q with respect to the nip portion NP.

Third Embodiment

Next, a printer 1 of a third embodiment will be explained. However, the printer 1 of the third embodiment is constructed in the same manner as the printer 1 of the embodiment described above except that the control on the PF motor 81 is switched from the closed loop control to the open loop control irrelevant to the output signals from the sensors 89, 91. Therefore, the construction, which is different from that of the embodiment described above, will be selectively explained below as the explanation about the printer 1 of the third embodiment.

Figure 11:
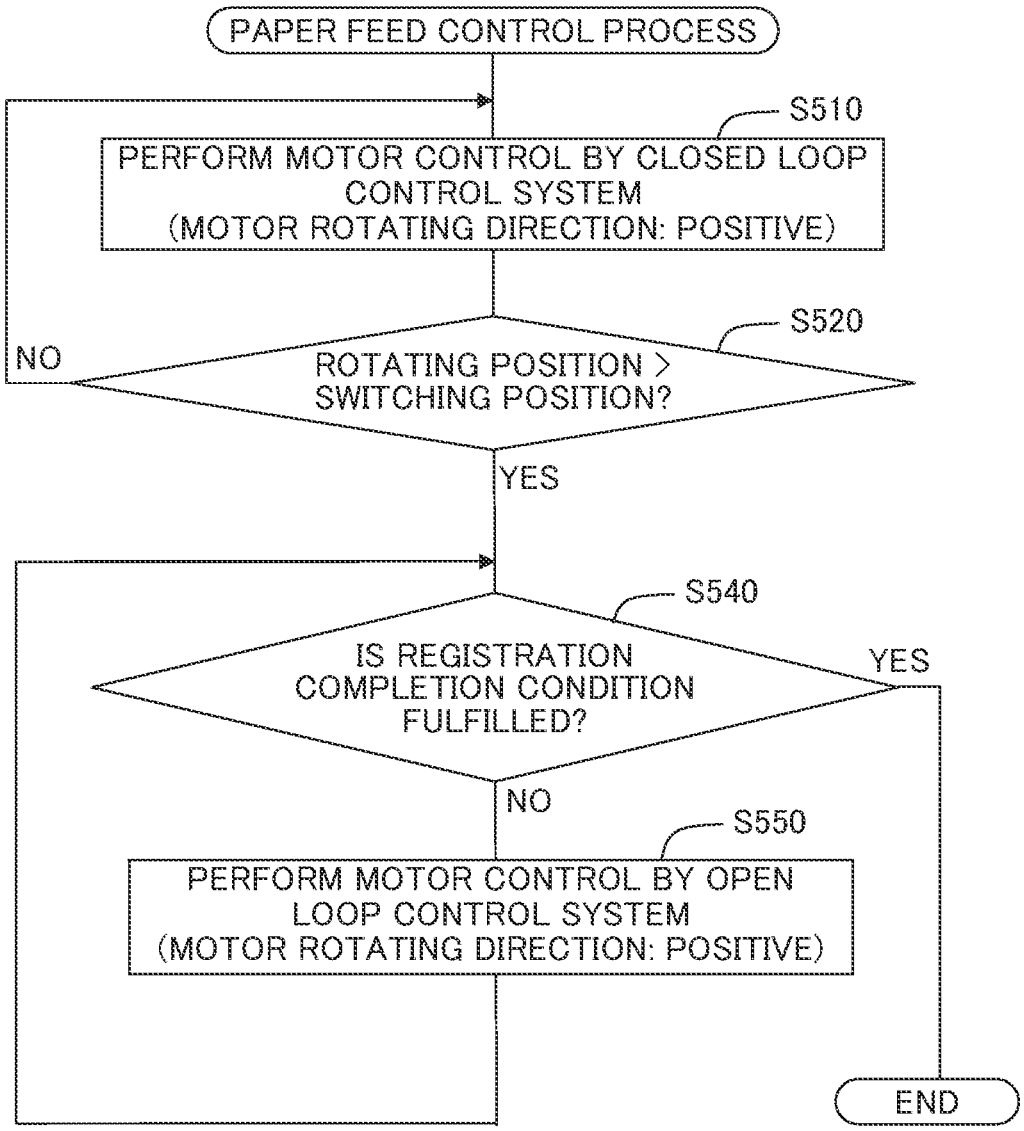
FIG. 11 shows a flow chart illustrating a paper feed control process in a third embodiment.

The PF motor controller 35 of the third embodiment executes a paper feed control process shown in FIG. 11 in place of the paper feed control processes shown in FIGS. 5 and 10. When the paper feed control process is started, the PF motor controller 35 executes the closed loop control on the PF motor 81 in the same manner as in Step S210 of the first embodiment. Accordingly, the paper feed roller 62 is positively rotated. In accordance with the rotation, the transport control is realized for the printing paper Q such that one sheet of the printing paper Q is separated from the paper feeding tray 61 and the sheet of the printing paper Q is transported to the downstream of the printing paper transport passage (S510).

However, the PF motor controller 35 of this embodiment executes the closed loop control including the calculation of the current command value U based on the difference E and the output of the PWM signal based on the current command value U until the rotation position X of the PF motor 81 obtained from the measuring circuit 87 arrives at a predetermined switching position X0.

In other words, when the rotation position X of the PF motor 81 obtained from the measuring circuit 87 exceeds the switching position X0 (Yes in S520), the PF motor controller 35 switches the control on the PF motor 81 from the closed loop control to the open loop control, and the open loop control is repeatedly executed until a predetermined registration completion condition is fulfilled (S540, S550).

The switching position X0 is previously determined by a designer on the basis of the pattern of the load fluctuation acting on the paper feed roller 62 from the printing paper Q. Specifically, when the printing paper Q is normally transported in accordance with the rotation of the paper feed roller 62, then the switching position X0 may be set to a position at which the leading head of the printing paper Q enters the upstream side end portion of the curved area R1, or the switching position X0 may be set to a position at which the leading head of the printing paper Q passes through the downstream side end portion of the curved area R1.

When the former switching position X0 is set, the PF motor controller 35 switches the control on the PF motor 81 from the closed loop control to the open loop control at the timing which is the same as or equivalent to that of the second embodiment. On the other hand, when the latter switching position X0 is set, the PF motor controller 35 switches the control on the PF motor 81 from the closed loop control to the open loop control at the timing which is the same as or equivalent to that of the first embodiment. According to this embodiment, the control is switched on the basis of the measured value (rotation position X) of the measuring circuit 87 which represents the rotation amount of the PF motor 81 (transport amount of the printing paper Q) as described above.

As for the registration completion condition, it is possible to adopt the condition which is the same as or equivalent to that of the second embodiment. When the registration completion condition is fulfilled (Yes in S540), the PF motor controller 35 completes the concerning paper feed control process.

The printer 1 of the third embodiment has been explained above. According to the printer 1 of this embodiment, it is also possible to suppress the stop of the printing paper Q during the transport, which would be otherwise caused by any sudden load fluctuation, in the same manner as in the first embodiment and the second embodiment. It is possible to appropriately realize the registration operation for the printing paper Q by using the small-sized motor as the PF motor 81.

Fourth Embodiment

Next, a printer 1 of a fourth embodiment will be explained. However, the printer 1 of the fourth embodiment is different from that of the embodiment described above to such an extent that the contents of the paper feed control process and the edge-alignment control process executed by the PF motor controller 35 are different from those of the embodiment described above. Therefore, in the following description, the contents of the paper feed control process and the edge-alignment control process executed by the PF motor controller 35 will be selectively explained with reference to FIGS. 12 and 13 as the explanation about the printer 1 of the fourth embodiment.

Figure 12:
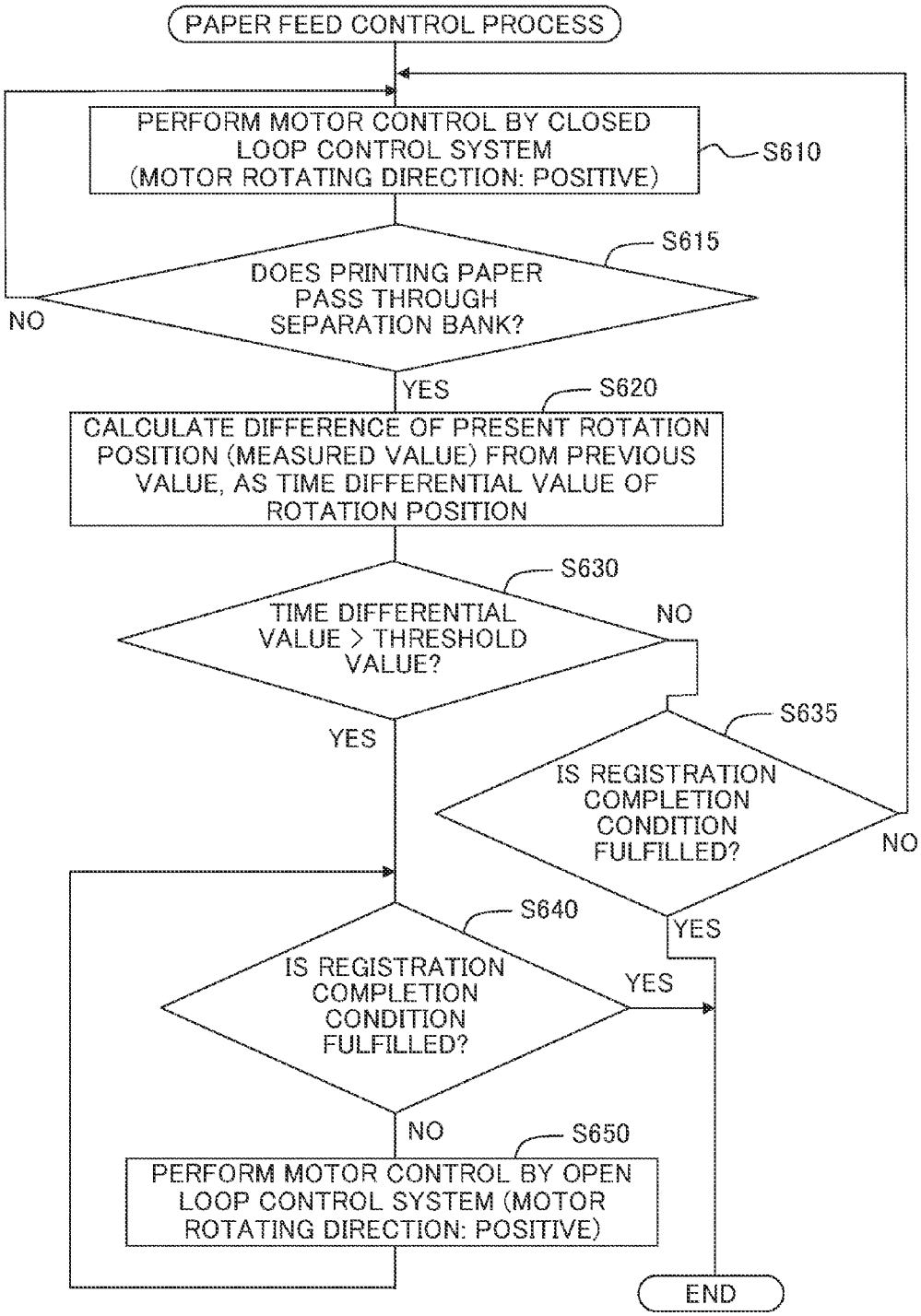
FIG. 12 shows a flow chart illustrating a paper feed control process in a fourth embodiment.

When the paper feed control process shown in FIG. 12 is started, the PF motor controller 35 of this embodiment starts the closed loop control on the PF motor 81 in the same manner as in S210 of the first embodiment. Accordingly, the paper feed roller 62 is positively rotated. In accordance with the rotation, the transport control is realized for the printing paper Q such that one sheet of the printing paper Q is separated from the paper feeding tray 61 and the sheet of the printing paper Q is transported to the downstream of the printing paper transport passage (S610).

However, after the start of the closed loop control, it is judged whether or not the forward end of the printing paper Q passes through the separation bank 71 on the basis of the rotation position X of the PF motor 81 obtained from the measuring circuit 87 (S615). When it is judged that the forward end of the printing paper Q does not pass through the separation bank 71 (No in S615), then the process proceeds to S610, and the closed loop control is continued. When it is judged that the forward end of the printing paper Q passes through the separation bank 71 (Yes in S615), the process proceeds to S620.

When the process proceeds to S620, the PF motor controller 35 calculates the absolute value $|X-Xp|$ of the difference between the present rotation position X obtained from the measuring circuit 87 and the previous rotation position Xp, as the time differential value of the rotation position X (S620). In this procedure, the process of Step S620 is performed periodically and repeatedly after the forward end of the printing paper Q passes through the separation bank 71. The previous rotation position Xp, which is referred to herein, is the rotation position X obtained from the measuring circuit 87 in the process of S620 performed immediately before. In each of the processes of S620, the present rotation position X obtained from the measuring circuit 87 is stored in order to calculate the time differential value for the rotation position X in the next process of S620.

After the process in S620, the PF motor controller 35 judges whether or not the time differential value exceeds a preset threshold value (S630). When the PF motor controller 35 judges that the time differential value is not more than the threshold value (No in S630), the PF motor controller 35 judges whether or not the registration completion condition is fulfilled (S635). When it is judged that the registration completion condition is not fulfilled (No in S635), the process proceeds to S610.

In accordance with the procedure as described above, the PF motor controller 35 continues the closed loop control while repeatedly performing the processes of S620, S630, S635. As for the registration completion condition, it is possible to adopt the condition which is the same as or equivalent to that of the second embodiment.

On the other hand, when the PF motor controller 35 judges that the time differential value exceeds the threshold value (Yes in S630), the process proceeds to S640. Further, the PF motor controller 35 switches the control on the PF motor 81 from the closed loop control to the open loop control. The open loop control, which is the same as or equivalent to S250, S450, is repeatedly executed until the registration completion condition is fulfilled (S640, S650). As for the registration completion condition, it is possible to adopt the condition which is the same as that of S635.

When it is judged that the registration completion condition is fulfilled (Yes in S635 or S640), the PF motor controller 35 completes the concerning paper feed control process. That is, according to this embodiment, whether or not any large fluctuation arises in the rotation position X (measured value) of the PF motor 81 obtained from the measuring circuit 87 is digitized by the time differential value. When the fluctuation exceeds the threshold value, then this phenomenon is regarded as a sign or indication of the stop of the printing paper Q which is being transported, and the control on the PF motor 81 is switched from the closed loop control to the open loop control. Further, the registration operation is completed in accordance with the open loop control.

Actually, when the closed loop control is continued even when the fluctuation of the rotation position X is increased, then the fluctuation triggers the occurrence of the vibration in the current command value U for the PF motor 81, and there is such a possibility that the printing paper Q which is being transported may be stopped.

On the other hand, when the time differential value is not more than the threshold value and any sign of the stop of the printing paper Q which is being transported does not appear, then the PF motor controller 35 continues the closed loop control as the control on the PF motor 81, and the registration operation is completed. When the registration operation is completed in accordance with the closed loop control, the PF motor 81 is controlled so that the printing paper Q is transported by an amount which is larger by a predetermined amount than the transport amount required for the leading head of the printing paper Q to arrive at the nip portion NP in accordance with the target position locus as shown by the solid line and the broken line in the upper part of FIG. 6.

Figure 13:
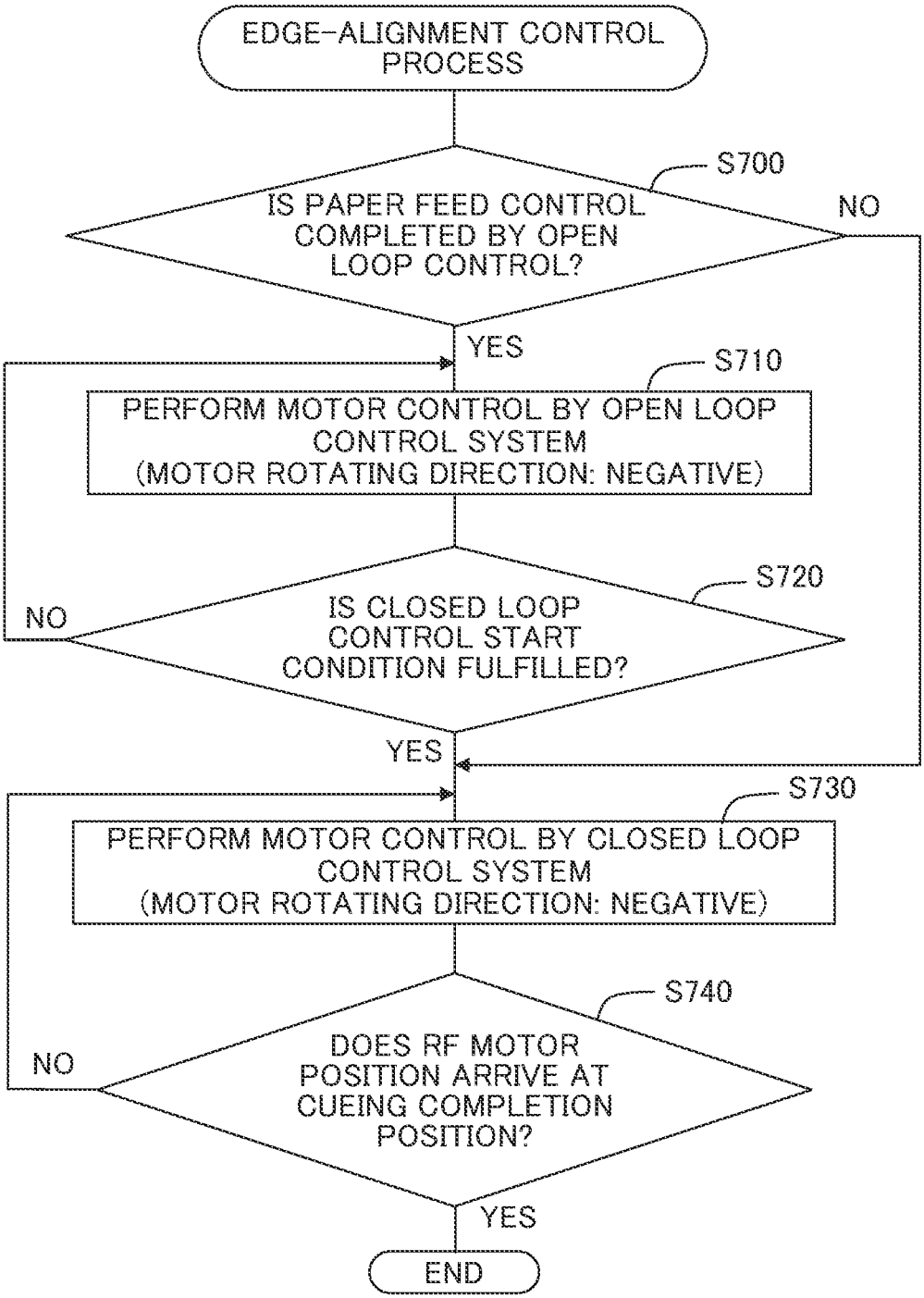
FIG. 13 shows a flow chart illustrating an edge-alignment control process in the fourth embodiment.

Further, the PF motor controller 35 starts the edge-alignment control process as shown in FIG. 13 in accordance with the instruction from CPU 11 after the completion of the paper feed control process as described above. In the curing control process, the PF motor controller 35 judges whether or not the paper feed control process performed just before is completed by the open loop control (S700). When it is judged that the paper feed control process is completed by the open loop control, the PF motor controller 35 executes, in S710 to S740, the processes which are the same as or equivalent to the processes in S310 to S340 in the first embodiment.

That is, the PF motor controller 35 positively rotates the transporting roller 64 in accordance with the open loop control on the PF motor 81 to realize the intake of the printing paper Q from the nip portion NP (S710). Further, when the closed loop control start condition is fulfilled (Yes in S720), the PF motor controller 35 switches the control on the PF motor 81 from the open loop control to the closed loop control. The PF motor controller 35 executes the closed loop control on the PF motor 81 until the rotation position Z of the PF motor 81 arrives at the completion position Z1 of the edge-alignment control process (S730, S740). Further, when the rotation position Z of the PF motor 81 arrives at the position Z1 (Yes in S740), the PF motor controller 35 completes the edge-alignment control process.

On the other hand, when it is judged that the paper feed control process is completed by the closed loop control, the PF motor controller 35 positively rotates the transporting roller 64 in accordance with the closed loop control to realize the intake of the printing paper Q from the nip portion NP (S730). The PF motor controller 35 continues the closed loop control until the rotation position Z of the PF motor 81 arrives at the position Z1 (S730, S740). Further, when the rotation position Z of the PF motor 81 arrives at the position Z1 (Yes in S740), the PF motor controller 35 completes the concerning edge-alignment control process.

The printer 1 of the fourth embodiment has been explained above. Also in the printer 1 of this embodiment, it is possible to suppress the stop of the printing paper Q during the transport, which would be otherwise caused by the sudden load fluctuation.

According to this embodiment, it is judged in S615 whether or not the forward end of the printing paper Q passes through the separation bank 71. However, it is also allowable that the judgment in S615 is not made, when the time differential value of the rotation position X does not exceed the threshold value before the forward end of the printing paper Q passes through the separation bank 71.

Fifth Embodiment

Next, a printer 1 of a fifth embodiment will be explained. However, the printer 1 of the fifth embodiment is constructed identically with the printer 1 of the fourth embodiment except that the contents of the paper feed control process executed by the PF motor controller 35 are different. Therefore, in the following description, the construction, which is different from that of the fourth embodiment, will be selectively explained as the explanation in relation to the printer 1 of the fifth embodiment.

Figure 14:
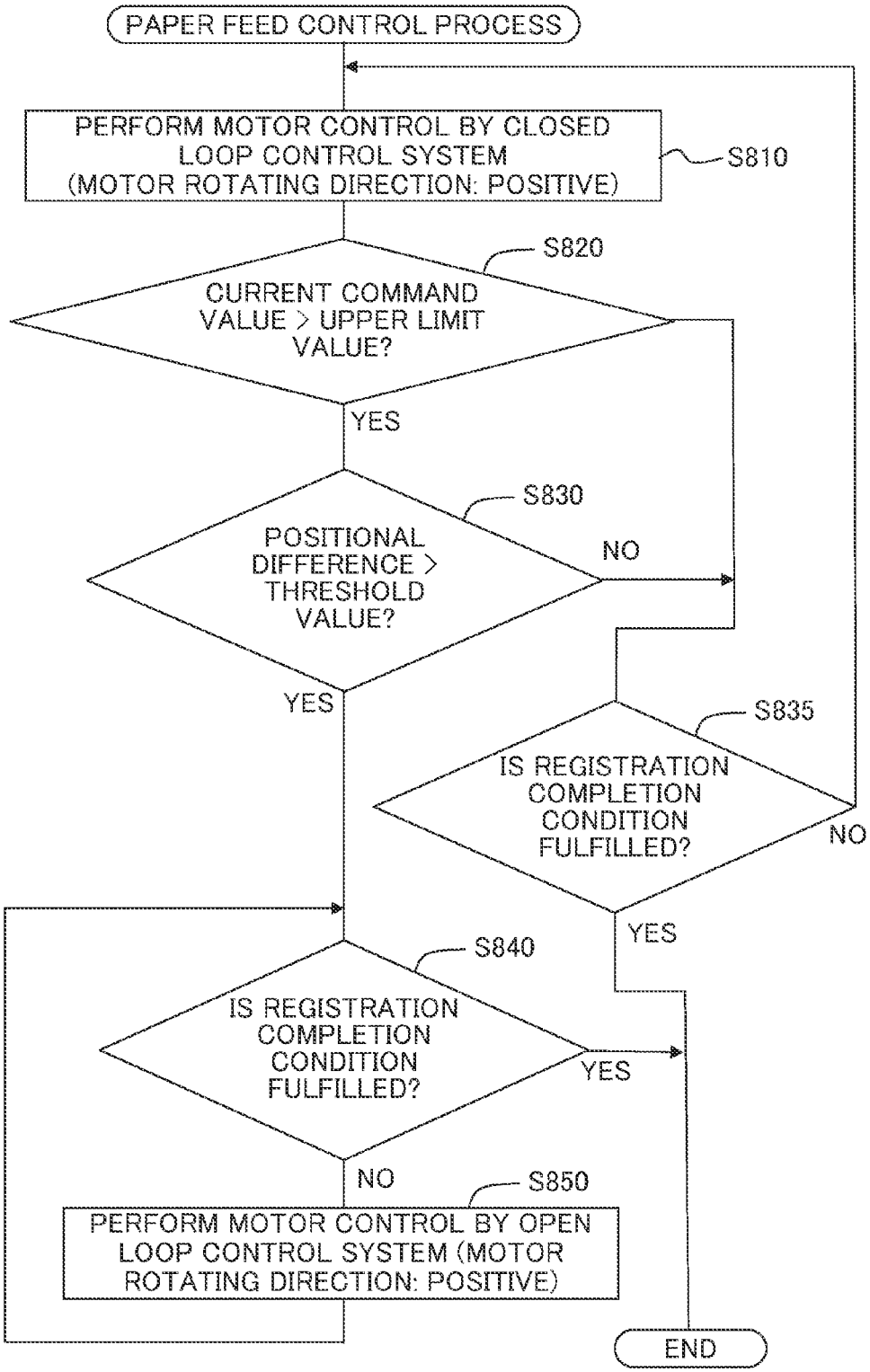
FIG. 14 shows a flow chart illustrating a paper feed control process in a fifth embodiment.

The PF motor controller 35 of the printer 1 of the fifth embodiment executes the paper feed control process shown in FIG. 14. When the paper feed control process is started, the PF motor controller 35 firstly rotates the paper feed roller 62 positively in accordance with the closed loop control on the PF motor 81 in the same manner as in the processes in S210 and S610 to realize the separation of the printing paper Q from the paper feeding tray 61 and the transport control in relation to the separated printing paper Q to be transported to the downstream of the printing paper transport passage (S810).

After the start of the closed loop control, the PF motor controller 35 judges whether or not the current command value U, which is calculated in accordance with the concerning closed loop control, exceeds an upper limit value of the current capable of being inputted into the PF motor 81 (S820). In this situation, when it is judged that the current command value U does not exceed the upper limit value (No in S820), then the process proceeds to S835, and the PF motor controller 35 judges whether or not the registration completion condition is fulfilled. When the PF motor controller 35 judges that the registration completion condition is not fulfilled (No in S835), then the process proceeds to S810, and the closed loop control is continued.

On the other hand, when the PF motor controller 35 judges that the current command value U exceeds the upper limit value (Yes in S820), it is judged whether or not the difference or deviation E=Xr−X between the target position Xr used in the closed loop control and the rotation position X obtained from the measuring circuit 87 exceeds a threshold value (S830).

When the PF motor controller 35 judges that the difference E does not exceeds the threshold value (No in S830), the process proceeds to S835 to judge whether or not the registration completion condition is fulfilled. When the PF motor controller 35 judges that the registration completion condition is not fulfilled (No in S835), the process proceeds to S810 to continue the closed loop control.

On the other hand, when the PF motor controller 35 judges that the current command value U exceeds the upper limit value and the difference E exceeds the threshold value (Yes in S830), the PF motor controller 35 allows the process to proceed to S840. In the processes in S840 and the following, the PF motor controller 35 switches the control on the PF motor 81 from the closed loop control to the open loop control to continuously execute the open loop control in which the current command value U is a fixed value U1 (S850) until the registration completion condition is fulfilled (S840).

When the registration completion condition is fulfilled (Yes in S835 or S840), the PF motor controller 35 completes the concerning paper feed control process. In an environment in which the load is large and the rotation position X is diverged from the target position Xr even when the PF motor 81 is driven at the maximum output, there is such a possibility that the printing paper Q during the transport may be stopped due to the sudden fluctuation of the load to be caused thereafter. Further, in the environment in which the divergence occurs as described above, the closed loop control has no meaning any more.

For the reason as described above, in this embodiment, the control on the PF motor 81 is switched from the closed loop control to the open loop control at the point in time at which the rotation position X is diverged from the target position Xr to a certain extent in the state in which the current command value U exceeds the upper limit value. Further, the registration operation is completed by the open loop control.

On the other hand, when the phenomenon as described above does not occur, the closed loop control is continued as the control on the PF motor 81, and the registration operation is completed. After the completion of the registration operation, the edge-alignment control process is executed in the same manner as in the fourth embodiment in accordance with the input of the instruction from CPU 11 (see FIG. 13).

The printer 1 of the fifth embodiment has been explained above. Also according to the printer 1 of this embodiment, the effect, which is the same as or equivalent to that of the printer 1 of the embodiment described above, is provided in that it is possible to suppress the stop of the printing paper Q during the transport, which would be otherwise caused by the sudden load fluctuation.

According to this embodiment, there is theoretically such a possibility that the control on the PF motor 81 is switched from the closed loop control to the open loop control even before the forward end of the printing paper Q passes through the separation bank 71. Therefore, the paper feed control process may be constructed such that the processes in S820 and the followings are executed on condition that the forward end of the printing paper Q passes through the separation bank 71 in the same manner as in the fourth embodiment.

According to this embodiment, the control on the PF motor 81 is switched from the closed loop control to the open loop control on condition that the current command value U exceeds the upper limit value and the difference E exceeds the threshold value. However, the control on the PF motor 81 may be switched from the closed loop control to the open loop control on condition that the forward end of the printing paper Q passes through the separation bank 71 and the difference E exceeds the threshold value. That is, the judgment in S820 may be replaced with a judgment to judge whether or not the forward end of the printing paper Q passes through the separation bank 71.

Further, the judgment in S830 may be replaced with a judgment to judge whether or not the absolute value of the difference E exceeds the threshold value. That is, the PF motor controller 35 may be constructed such that the control on the PF motor 81 is switched from the closed loop control to the open loop control on condition that forward end of the printing paper Q passes through the separation bank 71 and the absolute value of the difference E exceeds the threshold value. Other than the above, the judgment in S830 may be replaced with a judgment to judge whether or not the measured rotation position X is larger than the target position Xr by not less than a threshold value. That is, the PF motor controller 35 may be constructed such that the control on the PF motor 81 is switched from the closed loop control to the open loop control on condition that the forward end of the printing paper Q passes through the separation bank 71 and the rotation position X is larger than the target position Xr by not less than the threshold value.

OTHER EMBODIMENTS

The embodiments of the present teaching have been explained above. However, the present teaching is not limited to the embodiments described above, which may be embodied in other various forms.

For example, according to the embodiment described above, when the paper feed control process is completed by the open loop control and the edge-alignment control process is started thereafter by the open loop control, then the rotating direction of the PF motor 81 is suddenly switched consequently in the state in which the PF motor 81 is rotated at the high speed. In the case of the switching as described above, there is such a possibility that any shock and/or any impulsive sound may be generated in the printer 1 during the switching of the rotating direction.

Figure 15A:
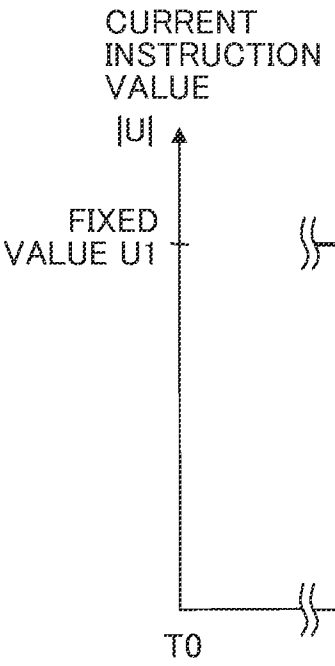
FIGS. 15A and 15B show a group of graphs illustrating the change of the current command value U in the open loop control before and after the edge-alignment control process.
Figure 15B:
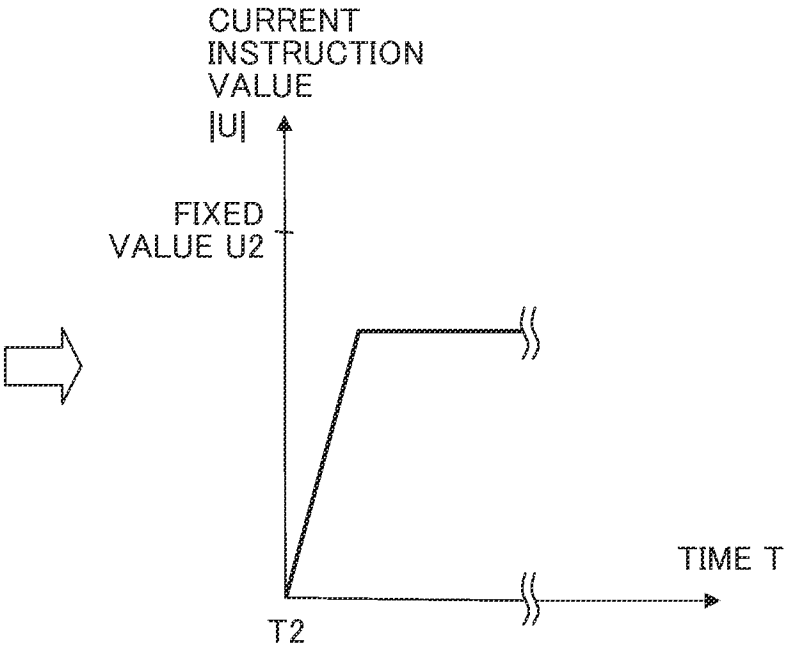

Therefore, in order to suppress the shock and/or the impulsive sound as described above, when the paper feed control process is completed by the open loop control, the following procedure is also available as shown in FIG. 15. That is, the current command value U (absolute value) is gradually lowered from a current command value U1 to zero immediately before the completion. After that, the current command value U (absolute value) is gradually raised from zero to a current command value U2 upon the start of the edge-alignment control process.

Further, according to the embodiment described above, the transporting roller 64 is reversely rotated in the paper feed control process in order to positionally adjust the printing paper Q. However, the positional adjustment of the printing paper Q may be performed in the paper feed control process by allowing the printing paper Q to abut against the nip portion NP in a state in which the transporting roller 64 is stopped. However, in this procedure, it is needed that the transporting roller 64 is not rotated when the printing paper Q is allowed to abut.

Other than the above, according to the embodiment described above, the paper feed roller 62 and the transporting roller 64 are driven by means of one PF motor 81. However, the printer 1 may be provided with individual motors for the paper feed roller 62 and the transporting roller 64 respectively. That is, the printer 1 may be constructed so that the paper feed roller 62 and the transporting roller 64 are driven respectively by means of the individual motors.

Other than the above, the first to fifth embodiments are illustrative of the exemplary cases in which the present teaching is applied to the printer 1. However, the present teaching is applicable to various electronic apparatuses or devices which involve the transport of the printing paper (sheet). Further, the technique of the embodiment described above makes it possible to appropriately transport the printing paper Q to the downstream of the transport route by using the small-sized motor when the printing paper Q is transported from the paper feeding tray 61 along the transport route in which the load fluctuation is large. Therefore, this technique is applicable to any printer provided with various types of printing paper transport mechanisms irrelevant to the construction of the printing paper transport mechanism 60 described above.

In the embodiments described above, the printer 1 has been explained, which executes the processes concerning the transport control in relation to the printing paper Q including the control on the PF motor 81 by means of CPU 11 and the PF motor controller 35. However, the processes may be realized by combining a computer and software or the processes may be realized by a hardware circuit without using any software. That is, all of the processes including the judging step as described above may be realized by a hardware circuit.

Correspondence or Correlation

The correspondence or correlation between the terms is as follows. The printing paper transport mechanism 60 corresponds to an example of the transport mechanism, CPU 11 and the PF motor controller 35 correspond to an example of the controller, and the rotary encoder 85 and the measuring circuit 87 correspond to an example of the measuring input unit.

Further, the rotation operations of the paper feed roller 62 and the transporting roller 64, which are realized by the printing paper transport mechanism 60 in accordance with the paper feed control process, correspond to the first operation. The rotation operations of the paper feed roller 62 and the transporting roller 64, which are realized by the printing paper transport mechanism 60 in accordance with the edge-alignment control process, correspond to the second operation.

What is claimed is:

1. A sheet transporting apparatus comprising:

a transport mechanism including a roller and configured such that a sheet as a transport object is taken out of a tray in accordance with rotation of the roller to transport the sheet to downstream of a transport path continued to the tray;

a motor configured to drive and rotate the roller;

a controller configured to control the motor so as to control the sheet transport in accordance with the rotation of the roller; and a measuring input unit configured to measure a control output brought about by the control on the motor and to input a measured value of the control output into the controller, wherein the transport path includes a curved area for inverting the sheet; and the controller is configured such that the controller executes the control on the motor by means of a closed loop control system which uses the measured value of the control output at an initial stage of the sheet transport from the tray, and the control on the motor is switched from the control performed by the closed loop control system to control performed by an open loop control system on condition that a particular phenomenon arises after the sheet is taken out of the tray, wherein the controller is configured such that the control on the motor is switched to the control performed by the open loop control system on condition that a phenomenon, in which the sheet arrives at a preset switching position in the transport path, arises as the particular phenomenon; and wherein the controller is configured such that the control on the motor is switched to the control performed by the open loop control system on condition that a phenomenon, in which the sheet arrives at a specified position set on downstream from an upstream side end portion of the curved area as the switching position, arises.

2. The sheet transporting apparatus according to claim 1, wherein the controller is configured such that the control on the motor is switched to the control performed by the open loop control system on condition that a change, which is not less than a reference, arises in the measured value of the control output as the phenomenon.

3. The sheet transporting apparatus according to claim 2, wherein the controller is configured to execute a process for controlling the motor to suppress a deviation between a target value and the measured value on the basis of the target value of the control output and the measured value of the control output at each point in time from start of the control, as the control performed by the closed loop control system, and the controller is configured such that the control on the motor is switched to the control performed by the open loop control system on condition that a change, which is not less than a reference, arises in the deviation as the change of the measured value which is not less than the reference.

4. The sheet transporting apparatus according to claim 3, wherein the controller is configured such that the control on the motor is switched to the control performed by the open loop control system on condition that a change, in which the deviation is not less than a threshold value, arises as the change of the deviation which is not less than the reference.

5. The sheet transporting apparatus according to claim 2, wherein the controller is configured to switch the control on the motor to the control performed by the open loop control system on condition that a change of the measured value, in which a time-differentiating the measured value of the control output is not less than a threshold value, arises as the change of the measured value which is not less than the reference.

6. The sheet transporting apparatus according to claim 1, further comprising:

a separation mechanism configured to separate a plurality of the sheets accommodated in the tray, wherein the transport mechanism includes an arm which rotatably holds the roller at one end and which includes a rotational shaft at the other end; and the transport mechanism configured to transport the sheet toward the separation mechanism and to transport the sheet to the downstream of the transport path by rotating the roller in a state in which the roller contacts the sheet accommodated by the tray.

7. The sheet transporting apparatus according to claim 1, wherein as the roller, the transport mechanism includes:

a supply roller which takes out the sheet as the transport object from the tray in accordance with rotation; and a transporting roller which is disposed on the downstream of the transport path as compared with the supply roller and which is configured to transport the sheet transported from the tray to the further downstream in accordance with rotation, the transport mechanism being configured to receive a motive power from the motor controlled by the controller and perform:

a first movement for rotating the supply roller in a positive rotating direction to transport the sheet to the downstream in a state in which the transporting roller is rotated in an opposite direction opposite to the positive rotating direction to transport the sheet to the downstream or in a state in which the transporting roller is stopped; and a second movement for positively rotating the transporting roller after the first operation; and the controller being constructed such that:

the control on the motor is switched to the control performed by the open loop control system on condition that the phenomenon arises in a period of time until the sheet arrives at the transporting roller to complete the first movement after the sheet is taken out of the tray.

8. The sheet transporting apparatus according to claim 7, wherein the transport path is formed the curved area which is positioned in upstream from the transporting roller;

a sensor, which is configured to output a detection signal when a leading head of the sheet passes therethrough, is disposed at a downstream side end portion of the curved area; and the controller is configured such that the control on the motor is switched to the control performed by the open loop control system on condition that the detection signal is outputted from the sensor.

9. The sheet transporting apparatus according to claim 7, wherein the controller is configured such that the motor is controlled so that the sheet is transported in an amount larger by a predetermined amount than a transport amount required for a leading head of the sheet to arrive at the transporting roller in accordance with the first movement, and the transport mechanism is allowed to performed the second movement to transport the sheet to the downstream from the transporting roller by starting the control on the motor by means of the same control system as that used upon completion of the first movement, of the open loop control system and the closed loop control system after the first movement is completed.

10. The sheet transporting apparatus according to claim 7, wherein the controller is configured such that the control on the motor, which is performed by the open loop control system in order to allow the transport mechanism to perform the second movement, is started after the completion of the first movement performed by the open loop control system, and then the control on the motor is switched from the control performed by the open loop control system to the control performed by the closed loop control system under a condition that a predetermined closed loop control start condition is fulfilled.

11. The sheet transporting apparatus according to claim 10, wherein the controller is configured such that the control on the motor is switched to control performed by the closed loop control system assuming that the closed loop control start condition is fulfilled under a condition that a remaining transport amount of the sheet in a transport process arrives at a predetermined transport amount in the transport process for transporting the sheet after starting the control on the motor performed by the open loop control system after the completion of the first movement.

12. The sheet transporting apparatus according to claim 7, wherein the controller is configured such that the motor is controlled so that the transporting roller rotates in the opposite direction until the first movement is completed, and the transporting roller rotates in the positive rotating direction after the completion of the first movement, by switching the rotating direction of the motor between before and after the completion of the first movement; and the control on the motor, which is performed by the open loop control system, includes such a process that the input current to be inputted into the motor is gradually lowered to zero before the first movement is completed, and the input current is gradually raised after the completion of the first operation.

13. The sheet transporting apparatus according to claim 1, wherein the control performed by the open loop control system is such control that an input current to be inputted into the motor is retained at a fixed value.

14. The sheet transporting apparatus according to claim 13, wherein the controller is configured such that:

the input current to be inputted into the motor is retained at the fixed value in the control performed by the open loop control system; and under a condition that the control on the motor is performed by the open loop control system before and after the completion of the first movement, then the fixed value is switched between before and after the completion of the first movement so that the fixed value, which is used during the transport of the sheet after the completion of the first movement, is set to be lower than the fixed value which is used before the completion of the first movement.

15. An image forming system comprising:

the sheet transporting apparatus as defined in claim 1; and an image forming apparatus configured to form an image on the sheet transported by the sheet transporting apparatus.

16. A sheet transporting apparatus comprising:

a transport mechanism including a roller and configured such that a sheet as a transport object is taken out of a tray in accordance with rotation of the roller to transport the sheet to downstream of a transport path continued to the tray;

a motor configured to drive and rotate the roller;

a controller configured to control the motor so as to control the sheet transport in accordance with the rotation of the roller; and a measuring input unit configured to measure a control output brought about by the control on the motor and to input a measured value of the control output into the controller, wherein the transport path includes a curved area for inverting the sheet; and the controller is configured such that the controller executes the control on the motor by means of a closed loop control system which uses the measured value of the control output at an initial stage of the sheet transport from the tray, and the control on the motor is switched from the control performed by the closed loop control system to control performed by an open loop control system on condition that a particular phenomenon arises after the sheet is taken out of the tray, wherein the controller is configured such that the control on the motor is switched to the control performed by the open loop control system on condition that a phenomenon, in which the sheet arrives at a preset switching position in the transport path, arises as the particular phenomenon, and wherein the controller is configured such that the control on the motor is switched to the control performed by the open loop control system on condition that a phenomenon, in which the sheet arrives at a specified position set at a downstream side end portion of the curved area as the switching position, arises.

17. An image forming system comprising:

the sheet transporting apparatus as defined in claim 16; and an image forming apparatus configured to form an image on the sheet transported by the sheet transporting apparatus.

18. A sheet transporting apparatus comprising:

a transport mechanism including a roller and configured such that a sheet as a transport object is taken out of a tray in accordance with rotation of the roller to transport the sheet to downstream of a transport path continued to the tray;

a motor configured to drive and rotate the roller;

a controller configured to control the motor so as to control the sheet transport in accordance with the rotation of the roller; and a measuring input unit configured to measure a control output brought about by the control on the motor and to input a measured value of the control output into the controller, wherein the transport path includes a curved area for inverting the sheet; and the controller is configured such that the controller executes the control on the motor by means of a closed loop control system which uses the measured value of the control output at an initial stage of the sheet transport from the tray, and the control on the motor is switched from the control performed by the closed loop control system to control performed by an open loop control system on condition that a particular phenomenon arises after the sheet is taken out of the tray, wherein the controller is configured such that the control on the motor is switched to the control performed by the open loop control system on condition that a phenomenon, in which the sheet arrives at a preset switching position in the transport path, arises as the particular phenomenon, and wherein the controller is configured such that the control on the motor is switched to the control performed by the open loop control system on condition that a phenomenon, in which the sheet arrives at the switching position on the basis of a transport position of the sheet specified by the measured value of the control output, arises.

19. An image forming system comprising:

the sheet transporting apparatus as defined in claim 18; and an image forming apparatus configured to form an image on the sheet transported by the sheet transporting apparatus.

* * * * *